US008581510B2

(12) United States Patent
Nakada et al.

(10) Patent No.: US 8,581,510 B2
(45) Date of Patent: Nov. 12, 2013

(54) DISCHARGE LAMP LIGHTING APPARATUS

(75) Inventors: Katsuyoshi Nakada, Yawata (JP); Tomoyuki Nakano, Sakai (JP); Junichi Hasegawa, Kashiwara (JP); Koji Watanabe, Yawata (JP)

(73) Assignee: Panasonic Corporation, Osaka (JP)

( * ) Notice: Subject to any disclaimer, the term of this patent is extended or adjusted under 35 U.S.C. 154(b) by 297 days.

(21) Appl. No.: 12/993,894

(22) PCT Filed: May 26, 2009

(86) PCT No.: PCT/JP2009/059598

§ 371 (c)(1),
(2), (4) Date: Nov. 22, 2010

(87) PCT Pub. No.: WO2009/145184

PCT Pub. Date: Dec. 3, 2009

(65) Prior Publication Data

US 2011/0074310 A1 Mar. 31, 2011

(30) Foreign Application Priority Data

May 27, 2008 (JP) ..... 2008-138675
Jul. 28, 2008 (JP) ..... 2008-193077

(51) Int. Cl.
*H05B 37/02* (2006.01)

(52) U.S. Cl.
USPC ..... 315/291; 315/308; 315/224

(58) Field of Classification Search
USPC ..... 315/225, 226, 308, 307, 309, 291, 315/209 R, 247, 219, 209 M
See application file for complete search history.

(56) References Cited

U.S. PATENT DOCUMENTS

| | | | | |
|---|---|---|---|---|
| 5,773,937 | A * | 6/1998 | Miyazaki et al. | 315/246 |
| 6,437,515 | B1 * | 8/2002 | Kamoi et al. | 315/209 R |
| 6,445,137 | B1 * | 9/2002 | Okamoto et al. | 315/246 |
| 7,486,028 | B2 * | 2/2009 | Langeslag et al. | 315/209 R |
| 7,622,869 | B2 * | 11/2009 | Watanabe et al. | 315/291 |
| 7,944,150 | B2 * | 5/2011 | Hirao | 315/224 |
| 2004/0257001 | A1 | 12/2004 | Langeslag et al. | |

FOREIGN PATENT DOCUMENTS

| | | | |
|---|---|---|---|
| CN | 1133546 | | 10/1996 |
| CN | 1579118 | | 2/2005 |
| CN | 1922934 | | 2/2007 |
| EP | 1720383 | A1 * | 11/2006 |
| JP | 8-124687 | | 5/1996 |

(Continued)

OTHER PUBLICATIONS

China Office action, dated Apr. 28, 2013 along with an english translation thereof.

*Primary Examiner* — Douglas W Owens
*Assistant Examiner* — Amy Wang
(74) *Attorney, Agent, or Firm* — Greenblum & Bernstein, P.L.C.

(57) ABSTRACT

In order to suppress a peak of an excessive current and suppress a variation in a resonance voltage of a resonator, which are likely to occur immediately after a discharge lamp starts lighting, in a case where a high-frequency current continuously flows asymmetrically with respect to a zero current instead of flowing symmetrically on positive and negative sides immediately after the lighting since electrodes of the discharge lamp are not evenly warmed, the resonance voltage and the high-frequency current are finely adjusted in a resonance voltage and high-frequency current setting method including setting a drive frequency of an inverter circuit and varying output from a down-converter.

14 Claims, 21 Drawing Sheets

(56) References Cited

FOREIGN PATENT DOCUMENTS

| | | |
|---|---|---|
| JP | 2878350 | 1/1999 |
| JP | 2975032 | 9/1999 |
| JP | 2003-217888 | 7/2003 |
| JP | 2004-95334 | 3/2004 |
| JP | 2004-327117 | 11/2004 |
| JP | 2005-507554 | 3/2005 |

* cited by examiner

DISCHARGE LAMP LIGHTING APPARATUS

TECHNICAL FIELD

The present invention relates to a lighting device for a discharge lamp for lighting a high intensity discharge lamp such as a high-pressure mercury lamp and a metal halide lamp.

BACKGROUND ART

High intensity discharge lamps such as metal halide lamps have become increasingly used as various light sources in recent years, and such lamps are required to have long operating life.

FIG. 1 is a circuit diagram of a conventional discharge lamp lighting device for lighting a high-pressure discharge lamp. FIG. 2 is an operation waveform chart at a time when the lighting device shown in FIG. 1 starts operating, and shows temporal changes in a drive frequency of a polarity inversion (inverter) circuit, an output voltage of a down-converter, and a resonant voltage applied to the discharge lamp. In FIG. 1 and FIG. 2, a voltage supplied from a direct current power source 1 is controlled with a down-converter 2. A polarity inversion (inverter) circuit 3 is provided at an output terminal of the down-converter 2. Moreover, there is provided a serial resonance circuit 4 including a capacitor (C2) and an inductor (L3) which are connected to an output of the polarity inversion (inverter) circuit 3.

For the voltage to be applied to the discharge lamp, a pair of switching elements Q2 and Q5 and a pair of switching elements Q3 and Q4 in the polarity inversion (inverter) circuit 3 are alternately operated in a switching manner at a high frequency for a predetermined period, the high frequency being higher than a lighting frequency at the time of steady lighting.

In the case of starting to light the discharge lamp, the above-described discharge lamp lighting device turns on and off a pair of switching circuits and a pair of switching circuits, alternately, the switching circuits in each pair located diagonally from each other, and thereby generates a high-frequency voltage in a range from several tens of kilohertz to several hundreds of kilohertz between both connection terminals of each of the pairs of switching circuits. The resonance circuit 4 performs resonance boosting by use of this high-frequency voltage thereby to generate a high resonance voltage in the capacitor (C2). Then, the discharge lamp is lit by this high resonance voltage. Upon detection of lighting of the discharge lamp by use of a detection voltage detected by a voltage detection circuit 5, a control circuit turns on and off the pairs of switching circuits, alternately, to generate a low-frequency voltage in a range of several tens of hertz to several hundreds of hertz between both of the connection terminals. Thus, lighting is maintained.

Alternatively, a discharge lamp lighting device disclosed in Patent Document 1 (JP-A 2004-95334) aims to ensure a favorable starting operation even when a starting voltage is stepped up due to product variation or an end stage of a product life of a discharge lamp. To this end, the discharge lamp lighting device performs start control by turning on and off alternately a pair of switching elements Q2 and Q5 and a pair of switching elements Q3 and Q4, located diagonally from each other, while changing a drive frequency so that the drive frequency can sweep a predetermined frequency range to pass through a resonance point of a resonance circuit.

Meanwhile, from a viewpoint of downsizing components constituting the resonance circuit 4 while obtaining substantially the same voltage amplitude as that obtained in the case of performing driving at the above-described frequency, a frequency of an odd-number multiple (2n+1, n is a natural number) of a frequency of abridge portion is sometimes employed as a lighting frequency at the time of the start control. This voltage amplitude is gradually decreased as the multiplying factor becomes higher. When the frequency of the bridge portion is tripled in particular, it is possible to obtain substantially the same voltage amplitude as that obtained in a case of performing driving at a frequency equivalent to a resonance frequency f0 which is determined by an inductor serially connected to the discharge lamp and by a capacitor connected in parallel thereto, and also it is possible to achieve downsizing of the resonance circuit 4. The use of this resonance voltage of a tertiary harmonic wave for starting the discharge lamp has also been disclosed in Patent Document 2 (Japanese Patent Translation Publication No. 2005-507554).

For example, the sweeping frequency is changed stepwise while causing the frequency of the polarity inversion (inverter) circuit 3 to gradually approach the resonance point, because most of general control methods for ballasts are digital control. Even when the frequency is changed stepwise by several percent each time, the resonance voltage is not proportional to the change rate of the frequency. Instead, the resonance voltage increased according to a quadratic function is generated. For this reason, a control circuit having high resolution and capable of performing fine frequency control has been used in order to finely set up the resonance frequency.

Meanwhile, in the case of the conventional circuit, electrodes of a discharge lamp (La) may not be evenly warmed up immediately after lighting of the discharge lamp is started by use of the resonance circuit 4, in some cases. Accordingly, a high-frequency current immediately after the lighting does not flow symmetrically on positive and negative sides, but there continues a state where the current flows asymmetrically with respect to a zero current. Such discharge lamp lighting devices have been disclosed in Patent Document 3 (Japanese Patent No. 2878350) and Patent Document 4 (Japanese Patent No. 2975032), for example. In the state of asymmetric flow of the current, a high-frequency current flows having a current peak which is nearly 1.5 to 2 times as large as a current peak in a state where the current flows symmetrically. This causes large damage on the electrodes of the lamp. Moreover, the electrodes of the lamp may be severely damaged if the lamp switches to steady lighting (low-frequency lighting) while in the above-described state. In the worst case, the electrodes may break off at the bottoms.

Further, the conventional circuit is provided with a starting mode and a preheating mode, and is switched to steady lighting (low-frequency lighting). In the preheating mode, the high-frequency current is applied for a certain time period such as a fixed time period set based on estimation in advance of a time period required for allowing the high-frequency current to flow symmetrically on the positive and negative sides, or a time period set based on detection of lighting of the discharge lamp (La).

Meanwhile, one of methods of suppressing the high-frequency asymmetric current in the preheating mode takes advantage of the fact that, while the polarity inversion (inverter) circuit 3 is operating at the high frequency due to insulation breakdown of the discharge lamp, the high-frequency current flowing in the discharge lamp is restricted by impedance of inductance of the resonance circuit 4. Here, the impedance is almost ignorable when the current at the low frequency is fed at the time of steady lighting. However, the inductance of this resonance circuit 4 acts as the impedance.

Accordingly, when the high-frequency current is fed, the drive frequency of the polarity inversion (inverter) circuit 3 is changed to increase the impedance serially connected to the discharge lamp, which suppresses the peak current of the asymmetric current at the start-up.

For example, assume that the inductance of the resonance circuit 4 is 100 μH, the polarity inversion (inverter) circuit 3 is operated at a high-frequency operation of 40 kHz, and the peak current (Io-p) of the asymmetric current is about 8 A (the peak current (Io-P) is about 4 A when the current is symmetric). In this case, the impedance ω of the inductance of the resonance circuit 4 is about 25Ω. To reduce the peak value of this asymmetric current approximately by half, the drive frequency of the polarity inversion (inverter) circuit 3 is raised to 80 kHz. As a result, the impedance of the inductance of the resonance circuit 4 becomes equal to about 50Ω, and the peak value of the asymmetric current is reduced by half.

In contrast, after the high-frequency current turns into a symmetric state, the high-frequency current is increased to promote preheating of the electrodes of the discharge lamp. Thus, by lowering the drive frequency of the polarity inversion (inverter) circuit 3, the impedance of the inductance of the resonance circuit 4 is reduced and the current is increased.

As described above, the drive frequency of the polarity inversion (inverter) circuit 3 is controlled to switch between a frequency for allowing the resonance circuit 4 to generate the resonance voltage at the start-up and a frequency for preheating the electrodes of the discharge lamp in the preheating mode. Once the discharge lamp is extinguished, the control has to be switched again from the preheating mode to the starting mode to change the drive frequency to such a drive frequency as to generate and supply the high voltage to the discharge lamp. Therefore, a time lag occurs for switching the control.

Moreover, since most of the general control methods for ballasts are digital control, the voltage to be changed is changed stepwise as similar to the generation of the resonance voltage. Accordingly, the control circuit having high resolution and capable of fine frequency control has been used in order to finely set the resonance frequency. However, there is also a problem that it is difficult to achieve fine adjustment of the high-frequency current by use of the control circuit incapable of performing fine frequency control.

CITATION LIST

Patent Literature

PLT 1: Japanese Unexamined Patent Application Publication No. 2004-95334

PLT 2: Japanese Unexamined Patent Application Publication (Translation of PCT Application) No. 2005-507554

PLT 3: Japanese Patent No. 2878350

PLT 4: Japanese Patent No. 2975032

SUMMARY OF INVENTION

Technical Problem

As described above, in order to light the high-pressure discharge lamp, the conventional discharge lamp lighting device generally applies the high-frequency resonance voltage to the discharge lamp by use of the resonance circuit or the like at the start-up, and thereby causes the high-pressure discharge lamp to start operation at the resonance voltage of the resonance circuit. The discharge lamp lighting device lights the discharge lamp with the resonance voltage set to a desired resonance voltage by adjusting the drive frequency of the polarity inversion (inverter) circuit and by detecting the resonance voltage. With use of such discharge lamp lighting device, the high-frequency current flows in the discharge lamp during a period from the brakedown of the discharge lamp to the turning to the steady lighting (low-frequency lighting). However, immediately after the brakedown of the discharge lamp, the high-frequency current flows in the discharge lamp asymmetrically with respect to the zero current in the state where electric discharge takes place from the bottoms of the electrodes instead of the tips thereof or in the state where one of the electrodes is not sufficiently preheated.

In the state where the high-frequency current flows in the discharge lamp asymmetrically with respect to the zero current as described above, the high-frequency current flows having a current peak of nearly 1.5 to 2 times as large as the current peak in the symmetric state, thereby causing large damage on the electrodes of the lamp. In the worst case, there may be a problem that the electrodes break off at the bottoms.

Moreover, there is another problem of damaging the discharge lamp attributable to the insufficient preheating of electrodes caused by a current shortage of the high-frequency current at the start-up, such as blackening due to electrode scattering.

Further, the starting voltage and the current flowing in the discharge lamp at the high frequency operation largely fluctuate due to variations in the inductance and the capacitance of the resonance circuit, and due to the size of a step interval between set frequencies for the case where the drive frequency of the polarity inversion (inverter) circuit is set by a microcomputer. In order to suppress such fluctuations, the resonance circuit having very small tolerances of the inductance and the capacitance has been selected or screened. Moreover, a high-performance control circuit capable of fine setting of the set frequency of the drive frequency of the polarity inversion (inverter) circuit is required. Therefore, costs for circuit components are increased.

The present invention has been made in view of the aforementioned problems and an object thereof is to provide a discharge lamp lighting device capable of suppressing variations attributable to inductance and capacitance of a resonance circuit and a drive frequency of a polarity inversion circuit, thereby suppressing variations in a starting voltage applied to a discharge lamp and a high-frequency current flowing in the discharge lamp, and thus achieving starting stability.

Solution to Problem

To solve the problems, in a lighting device for a discharge lamp according to the present invention, in order to suppress a peak of an excessive current and suppress a variation in a resonance voltage of a resonator, which are likely to occur immediately after a discharge lamp starts lighting, in a case where a high-frequency current continuously flows asymmetrically with respect to a zero current instead of flowing symmetrically on positive and negative sides immediately after the lighting since electrodes of the discharge lamp are not evenly warmed, the resonance voltage and the high-frequency current are finely adjusted in a resonance voltage and high-frequency current setting method including setting a drive frequency of a polarity inversion (inverter) circuit and varying output from a down-converter.

Advantageous Effects of Invention

According to the present invention, it is possible to suppress a variation attributable to a drive frequency of a polarity inversion (inverter) circuit, to suppress variations in a starting voltage to be applied to a discharge lamp and a high-frequency current flowing in the discharge lamp, thereby achieving starting stability.

BRIEF DESCRIPTION OF DRAWINGS

FIG. 1 is a circuit diagram showing a configuration of a conventional example.

FIG. 2 is an operation explanatory view of the conventional example.

FIG. 3 is an operation explanatory view of the conventional example.

FIG. 4 is a circuit block diagram showing a first embodiment of the present invention.

FIG. 5 is an explanatory view showing an operation of the first embodiment of the present invention.

FIG. 6 is an explanatory view showing another example of an operation of the first embodiment of the present invention.

FIG. 7 is an explanatory view showing still another example of an operation of the first embodiment of the present invention.

FIG. 8 is an explanatory view showing another example of an operation of the first embodiment of the present invention.

FIG. 9 is an explanatory view showing still another example of an operation of the first embodiment of the present invention.

FIG. 10 is a circuit block diagram showing another mode of the first embodiment of the present invention.

FIG. 11 is a circuit diagram showing a configuration of a second embodiment of the present invention.

FIG. 12 is an operation explanatory view of the second embodiment of the present invention.

FIG. 13 is an operation explanatory view of the second embodiment of the present invention.

FIG. 14 is an operation explanatory view of a third embodiment of the present invention.

FIG. 15 is an operation explanatory view of the third embodiment of the present invention.

FIG. 16 is an operation explanatory view of a fourth embodiment of the present invention.

FIG. 17 is an operation explanatory view of the fourth embodiment of the present invention.

FIG. 18 is another operation explanatory view of the fourth embodiment of the present invention.

FIG. 19 is another operation explanatory view of the third embodiment of the present invention.

FIG. 20 is an operation explanatory view of a fifth embodiment of the present invention.

FIG. 21 is a schematic configuration diagram of a light source lighting apparatus for a projector of a seventh embodiment of the present invention.

DESCRIPTION OF EMBODIMENTS

Now, embodiments for carrying out the present invention will be described below with reference to the accompanying drawings.

First Embodiment

Figure 1:
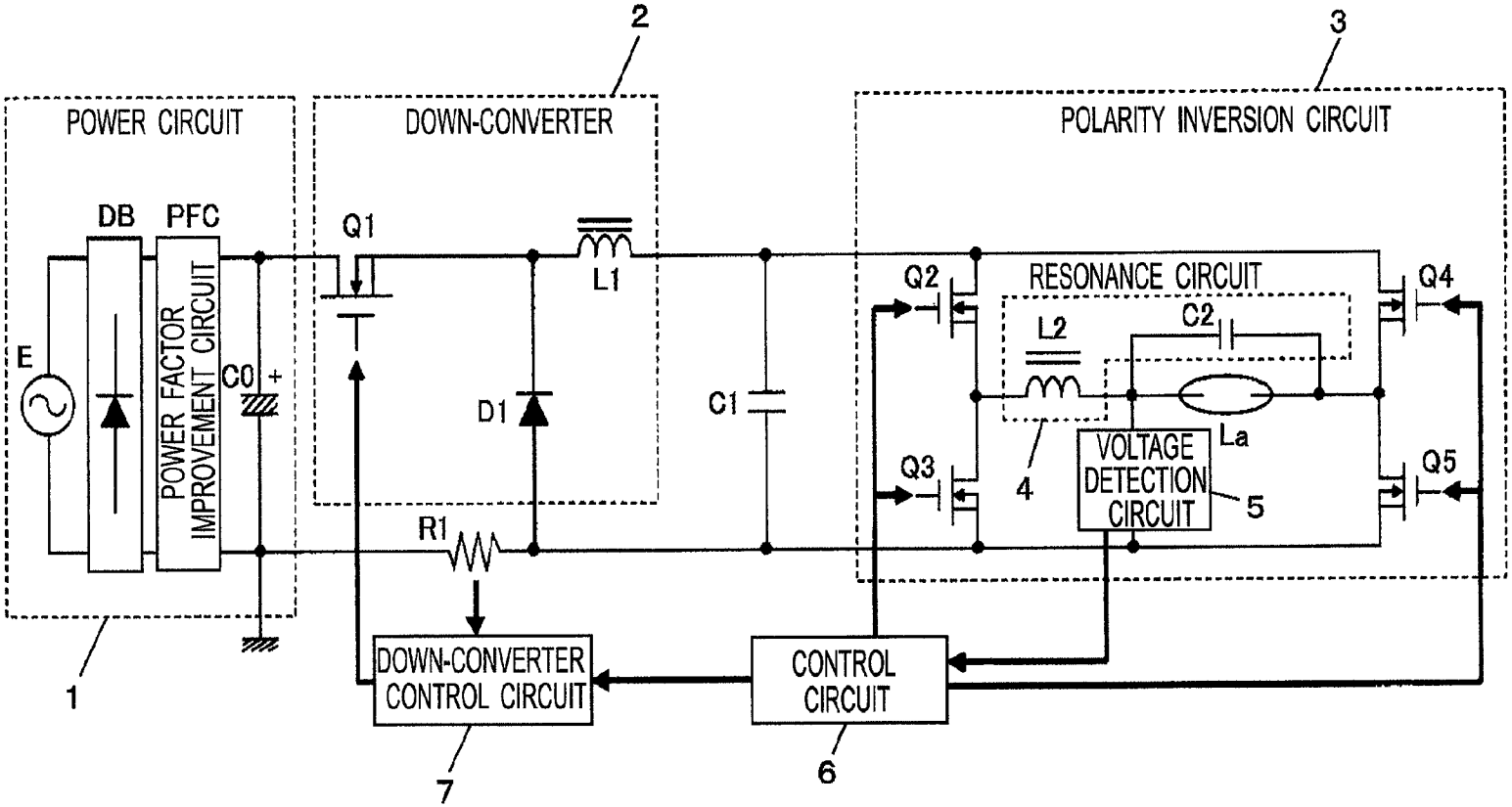
PRIOR ART FIG. 1
[FIG. 1]
Figure 2:
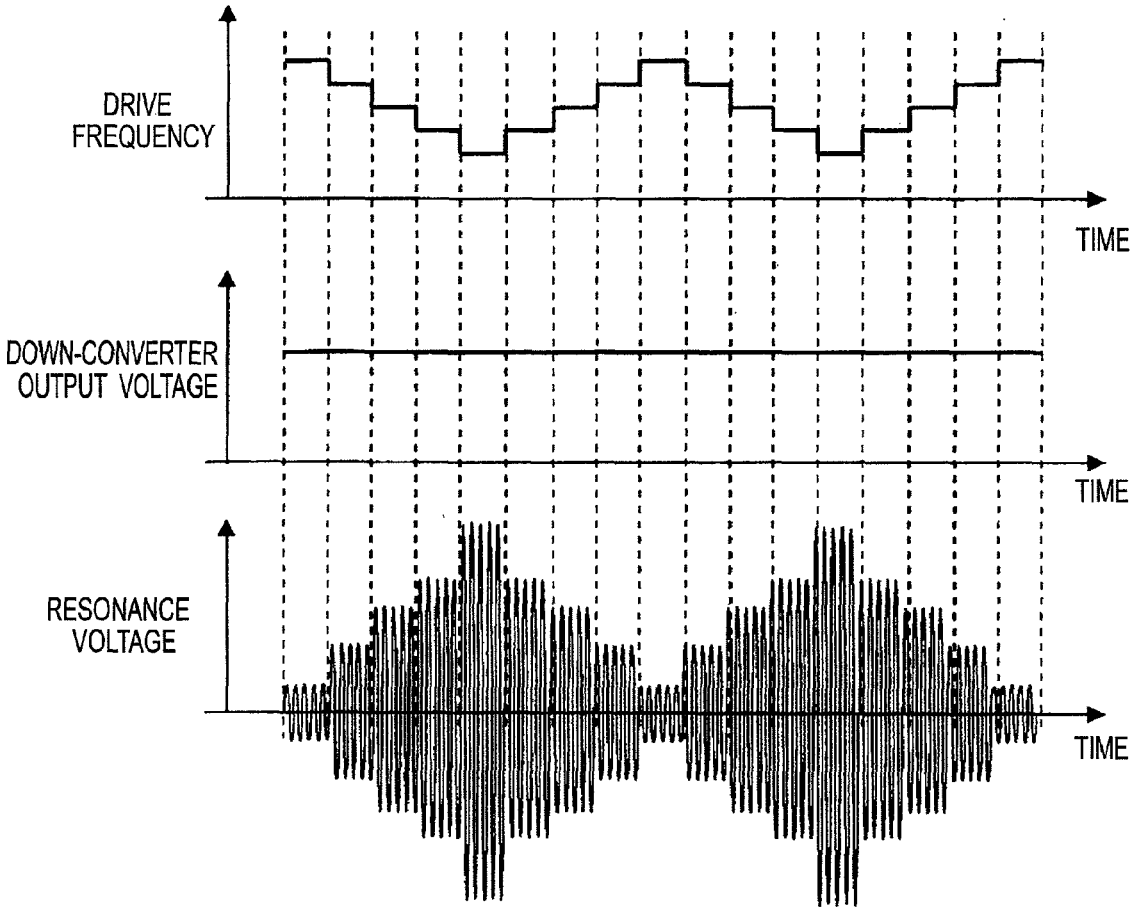
FIG. 2 PRIOR ART
[FIG. 2]
Figure 3:
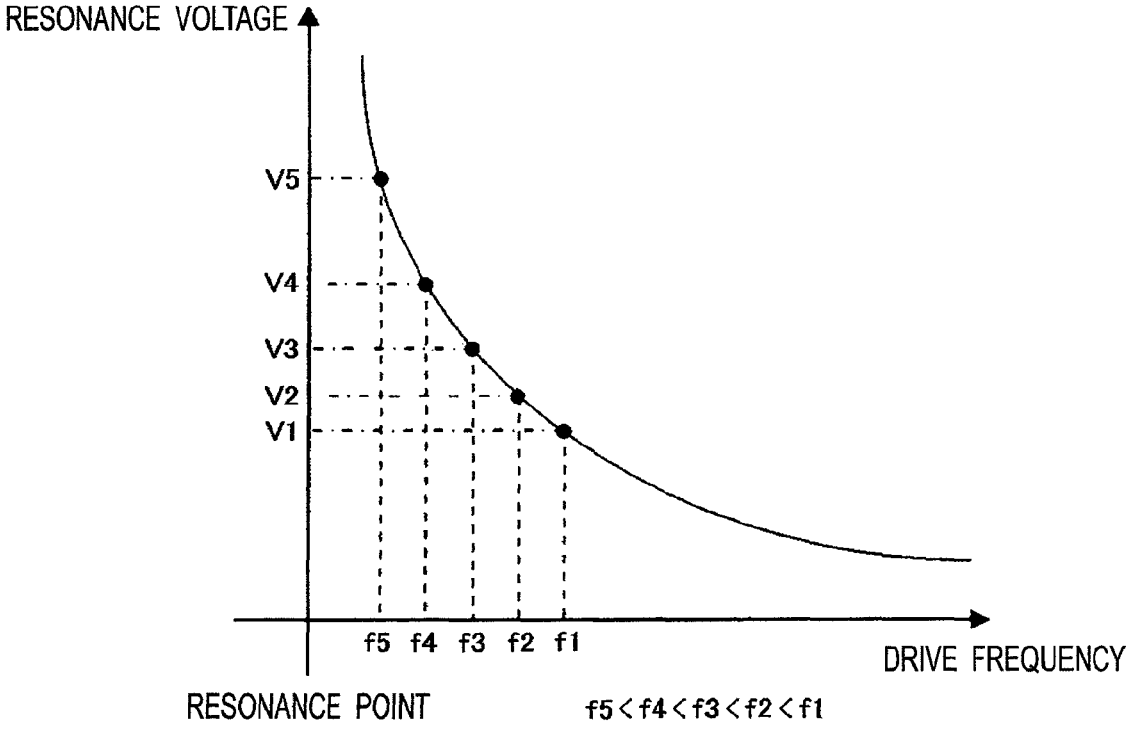
FIG. 3 PRIOR ART
[FIG. 3]
Figure 4:
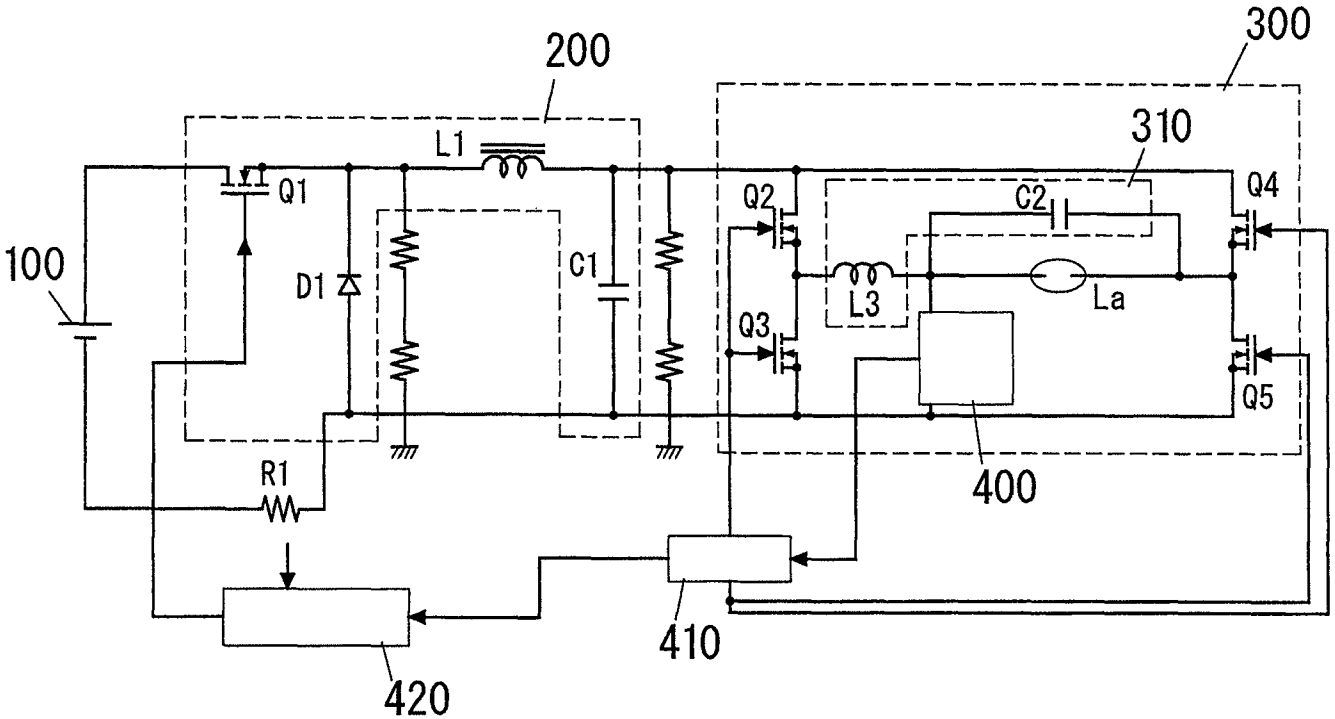
[FIG. 4]

As shown in FIG. 4, this first embodiment includes a down-converter circuit 200 that steps down direct current power inputted from a direct current power source 100 and outputs the stepped down current, and an inverter circuit 300 that converts the direct current power outputted from the down-converter circuit 200 into alternating current power and supplies the alternating current power to a discharge lamp La. The discharge lamp La in this first embodiment is a high-pressure discharge lamp which is also called a HID (high intensity discharge) lamp. The high-pressure discharge lamp of this type includes a high-pressure mercury lamp or a metal halide lamp, for example.

The down-converter circuit 200 is a well-known circuit also called a back converter or a step-down-converter. The down-converter circuit 200 includes a series circuit and a diode D1. The series circuit is formed of a switching element Q1, an inductor L1, and an output capacitor C1, and is connected between output terminals of the direct current power source 100. The diode D1 has its anode connected to a connecting point of the output terminal on a low voltage side of the direct current power source 100 to the output capacitor C1, and has its cathode connected to a connecting point of the switching element Q1 to the inductor L1. Both of terminals of the output capacitor C1 are used as output terminals. Further, this first embodiment includes a step-down drive circuit 420 that performs on-off drive of the switching element Q1. Meanwhile, a resistor R1 is connected between the output terminal on the low voltage side of the direct current power source 100 and the output capacitor C1. The step-down drive circuit 420 controls an output voltage from the down-converter circuit 200 by performing feedback control of an on-off duty ratio of the switching element Q1 on the basis of a voltage between both ends of the resistor R1 (i.e., by detecting the output voltage from the down-converter circuit 200 with the resistor R1). This step-down drive circuit 420 can be achieved by well-known techniques and detailed description and illustration thereof will be omitted.

The inverter circuit 300 is so-called an inverter circuit of a full-bridge type, which includes four switching elements Q2 to Q5 arranged such that series circuits each including two elements are connected mutually in parallel between output terminals of the down-converter circuit 200. Meanwhile, the switching elements Q4 and Q5 of one of the series circuits are connected to another end of the discharge lamp La. Further, the inverter circuit 300 includes a resonator 310 formed of an inductor L3 and a capacitor C2. The inductor L3 has one end connected to a connecting point of the switching elements Q2 and Q3 of one of the series circuits and has another end connected to one end of the discharge lamp La. The capacitor C2 is connected in parallel to the discharge lamp La.

In addition, this first embodiment includes an inverter drive circuit 410 configured to perform on-off drive of the switching elements Q2 to Q5 in a way that each of pairs of the switching elements Q2 to Q5 being diagonally located are turned simultaneously on and off, and that each of pairs of the switching elements Q2 to Q5 being connected in series are turned alternately on and off. Moreover, this first embodiment includes a lighting detection circuit 400 connected between a connecting point of the inductor L3 to the discharge lamp La and the output terminal on a low voltage side of the down-converter circuit 200. The lighting detection circuit 400 detects lighting and extinction of the discharge lamp La, and detects, during a period of detecting lighting of the discharge lamp La, a state (hereinafter referred to as an "asymmetric state") in which a current in the discharge lamp La (hereinafter referred to as a "lamp current") flows asymmetrically on positive and negative sides (i.e., having different peak values depending on the direction) (hereinafter referred to as an "asymmetric current"). The lighting detection circuit 400 and the inverter drive circuit 410 as described above can be achieved by well-known techniques and detailed description and illustration thereof will be omitted.

Figure 5:
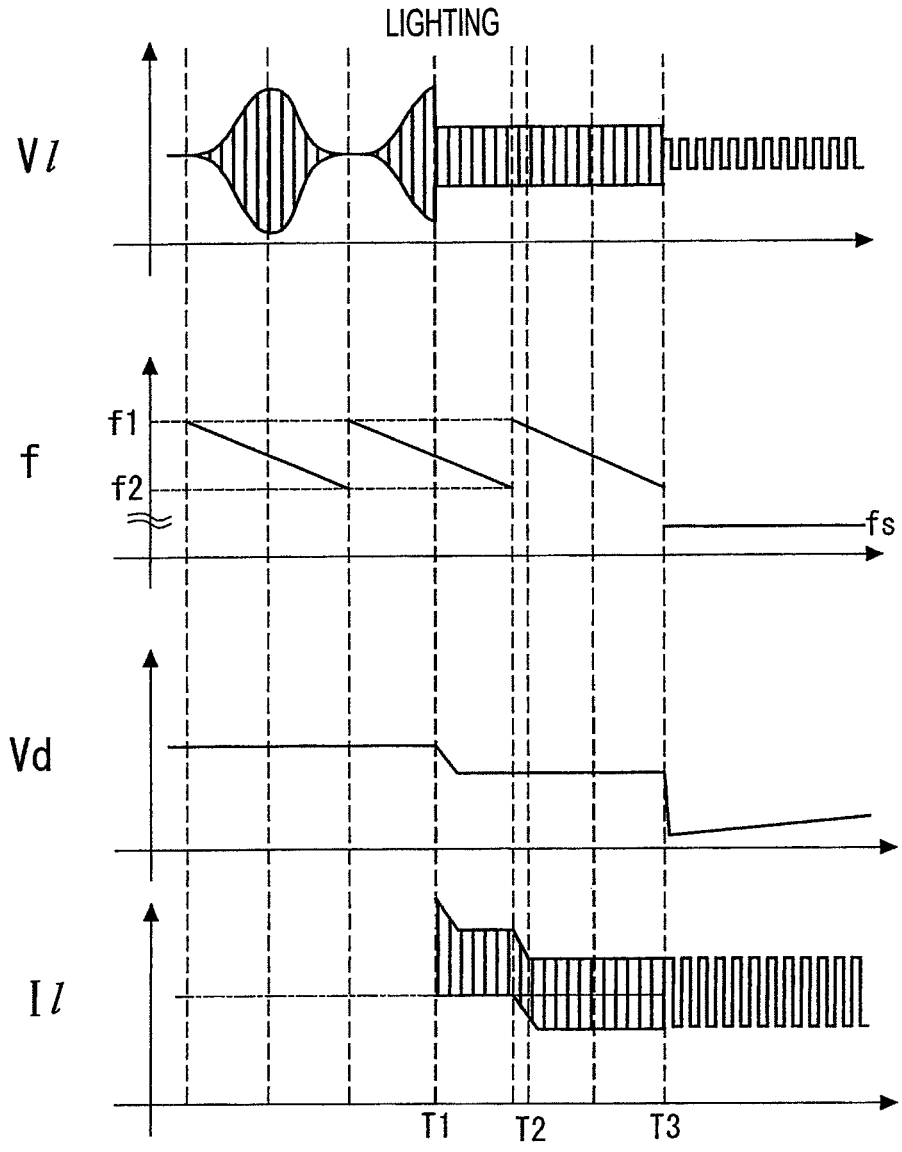
[FIG. 5]

Next, an operation of this first embodiment will be described by use of FIG. 5. In FIG. 5, a lateral axis in each of four graphs indicates time. A vertical axis in the graph on the top indicates a voltage (hereinafter referred to as a "resonance voltage") Vl to be applied to the discharge lamp La. A vertical axis in the graph on the second top indicates a drive frequency f. A vertical axis in the graph on the third top indicates an output voltage (hereinafter referred to as a "direct current output voltage") Vd from the down-converter circuit 200. A vertical axis in the graph at the bottom indicates a lamp current Il. The inverter drive circuit 410 periodically repeats a sweep operation to reduce the drive frequency f gradually from a predetermined first frequency f1 to a predetermined second frequency f2 lower than the first frequency f1 in a period (hereinafter referred to as a "starting period") from a point when the power is turned on to a time point T3. The time point T3 is a point at which a predetermined preheating period has elapsed since a time point T1 without detecting extinction, the time point T1 being a point when lighting of the discharge lamp La (i.e., initiation of electric discharge using the discharge lamp La) is detected by the lighting detection circuit 400. In other words, a length of the starting period is equal to a sum of time from the point when the power is turned on to the point (T1) when lighting of the discharge lamp La is detected by the lighting detection circuit 400 and the preheating period (T3-T1). The above-described preheating period is provided to preheat electrodes of the discharge lamp La. After the above-described starting period, the inverter drive circuit 410 performs a steady operation to maintain the drive frequency f at a steady frequency fs which is lower than the second frequency f2. The length of the starting period and the length of the preheating period are each set in a range from several tens of milliseconds to several hundreds of milliseconds, for example. The first frequency f1 and the second frequency f2 are each set to a high frequency in a range from several tens of kilohertz to several hundreds of kilohertz, for example. Meanwhile, the steady frequency fs is set to a low frequency in a range from several tens of hertz to several hundreds of hertz, for example. Moreover, the first frequency f1 is set to the frequency which is higher than an upper limit of an expected range of a resonance frequency of the resonator 310 (hereinafter simply referred to as a "resonance frequency"). Meanwhile, the second frequency f2 is set to the frequency which is lower than a lower limit of the expected range of the resonance frequency. In other words, the drive frequency f matches the resonance frequency at a certain time point in the sweep operation as long as the resonance frequency remains within the expected range.

Meanwhile, the step-down drive circuit 420 sets the direct current output voltage Vd during the starting period higher than that after the starting period. Further, the step-down drive circuit 420 maintains the direct current output voltage Vd substantially at a constant level in respective periods before and after the time point T1 when the lighting detection circuit 400 detects lighting of the discharge lamp La and detects the asymmetric state, and sets the direct current output voltage Vd to the lower level in the period after the above-described time point T1 than that in the period before the above-described time point T1. In this way, the peak value of the lamp current Il is reduced at the time point T1 when the lighting detection circuit 400 detects the asymmetric state. For example, if the direct current output voltage Vd is reduced by 20% from 200 V to 160 V in the asymmetric state where the peak value of the lamp current Il is 8 A, the peak value of the lamp current Il is reduced to about 6 A. In other words, the inverter drive circuit 410 and the step-down drive circuit 420 constitute a control circuit. Note that reference numeral T2 in FIG. 5 denotes timing when the asymmetric state is no longer detected by the lighting detection circuit 400.

According to the above-described configuration, by executing not only the control of the drive frequency f in the inverter circuit 300 but also the control of the output voltage (the direct current output voltage Vd) of the down-converter circuit 200, electrical stresses to the discharge lamp La and circuit components at the start-up can be kept lower than the case of controlling power supply to the discharge lamp La only by the control of the drive frequency f in the inverter circuit 300.

Moreover, the output voltage Vd from the down-converter circuit 200 is reduced and the peak value of the lamp current Il is thereby reduced upon occurrence of the asymmetric current at the start-up. Hence the electrical stresses to be applied to the circuit components by the asymmetric current are reduced.

Figure 6:
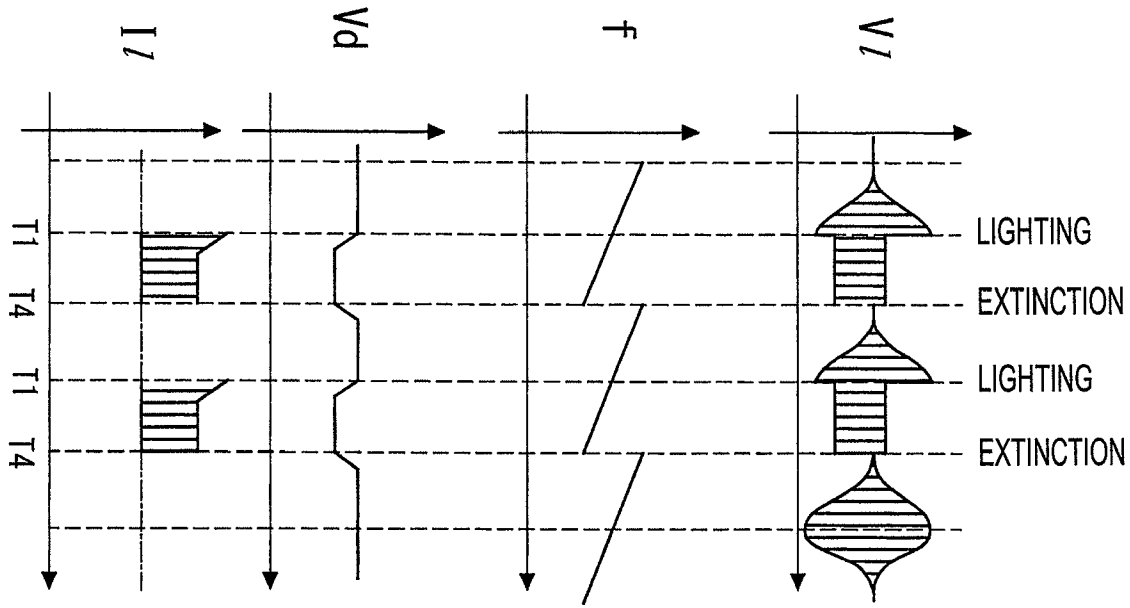
[FIG. 6]

Here, as shown in FIG. 6, at a time point T4 when the lighting detection circuit 400 detects extinction of the discharge lamp La during the period in which the asymmetric state is detected by the lighting detection circuit 400 and the direct current output voltage Vd is reduced, the step-down drive circuit 420 may increase the direct current output voltage Vd back to the voltage before the above-described reduction. By applying this configuration, the discharge lamp La can be lit again promptly as compared to the case of leaving the direct current output voltage Vd reduced even when extinction of the discharge lamp La is detected by the lighting detection circuit 400.

Figure 7:
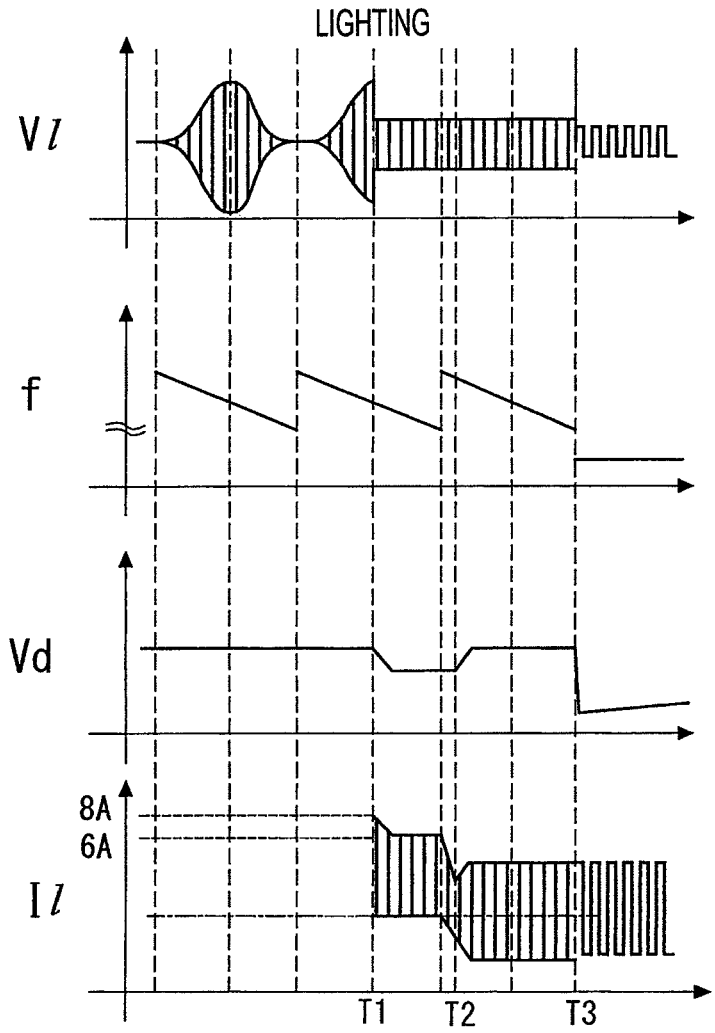
[FIG. 7]
Figure 8:
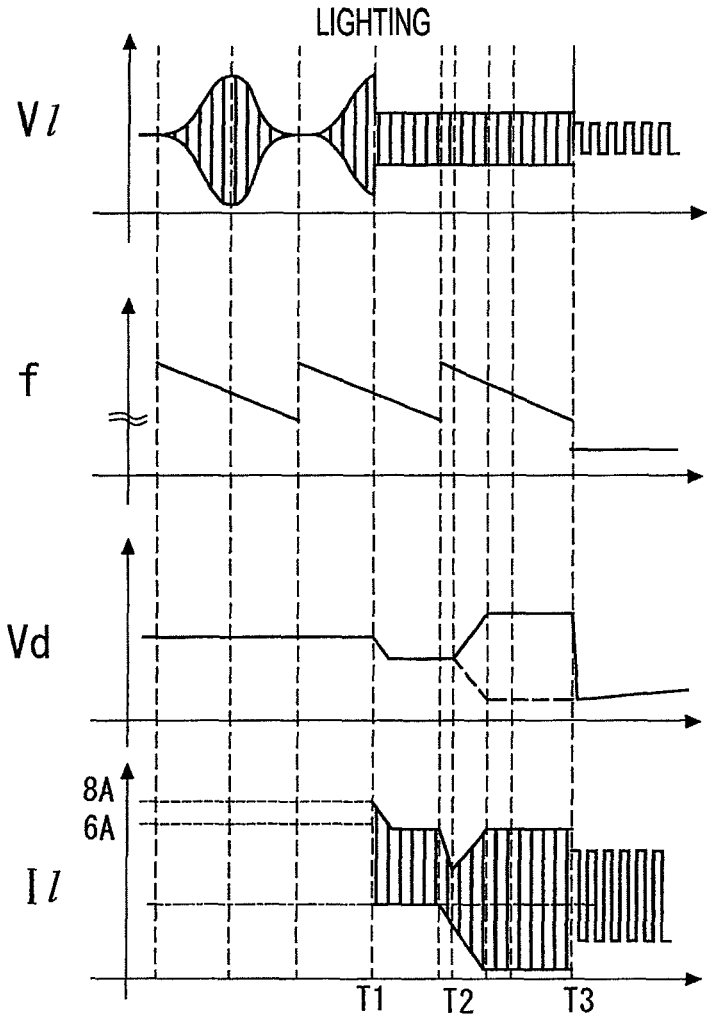
[FIG. 8]
Figure 9:
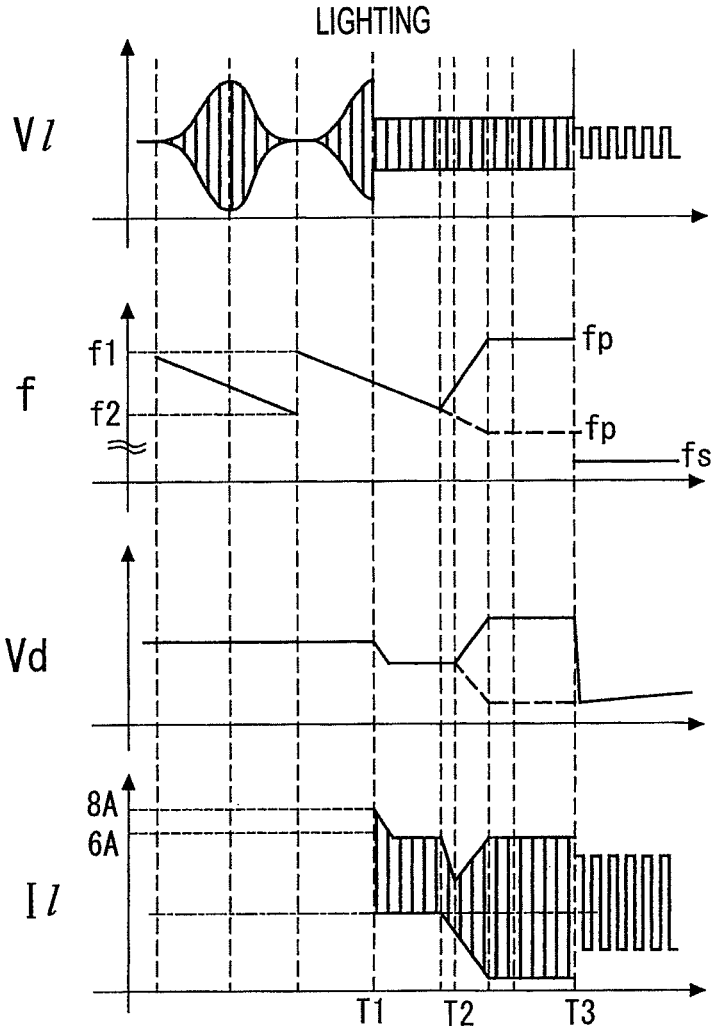
[FIG. 9]

Meanwhile, the step-down drive circuit 420 may change the direct current output voltage Vd at the timing T2 when the asymmetric state is no longer detected by the lighting detection circuit 400. The direct current output voltage Vd after the timing when the asymmetric state is no longer detected by the lighting detection circuit 400 may be set to an appropriate direct current output voltage Vd corresponding to the discharge lamp La. Here, it is possible to put the voltage back to the direct current output voltage Vd before detection of the asymmetric state as shown in FIG. 7 or to set the direct current output voltage Vd which is higher than the direct current output voltage Vd before detection of the asymmetric state as indicated with a solid line in FIG. 8. It is also possible to set the direct current output voltage Vd lower than the direct current output voltage Vd before detection of the asymmetric state as indicated with a dashed line in FIG. 8. Moreover, as shown in FIG. 9, the inverter drive circuit 410 may terminate the sweep operation at the timing T2 when the asymmetric state is not longer detected by the lighting detection circuit 400, and set the drive frequency f to a predetermined preheating frequency fp until the time point T3 of expiration of the starting period. The preheating frequency fp may be selected arbitrarily depending on a characteristic of the discharge lamp La. Here, it is possible to select a higher frequency than the first frequency f1 as indicated with a solid line in a graph of the drive frequency f in FIG. 9 or to select a lower frequency than the second frequency f2 as indicated with a dashed line in the graph of the drive frequency f in FIG. 9. When the preheating frequency fp is set high, amplitude of the lamp current Il is reduced by an increase in impedance of the inductor L3 and the like.

Figure 10:
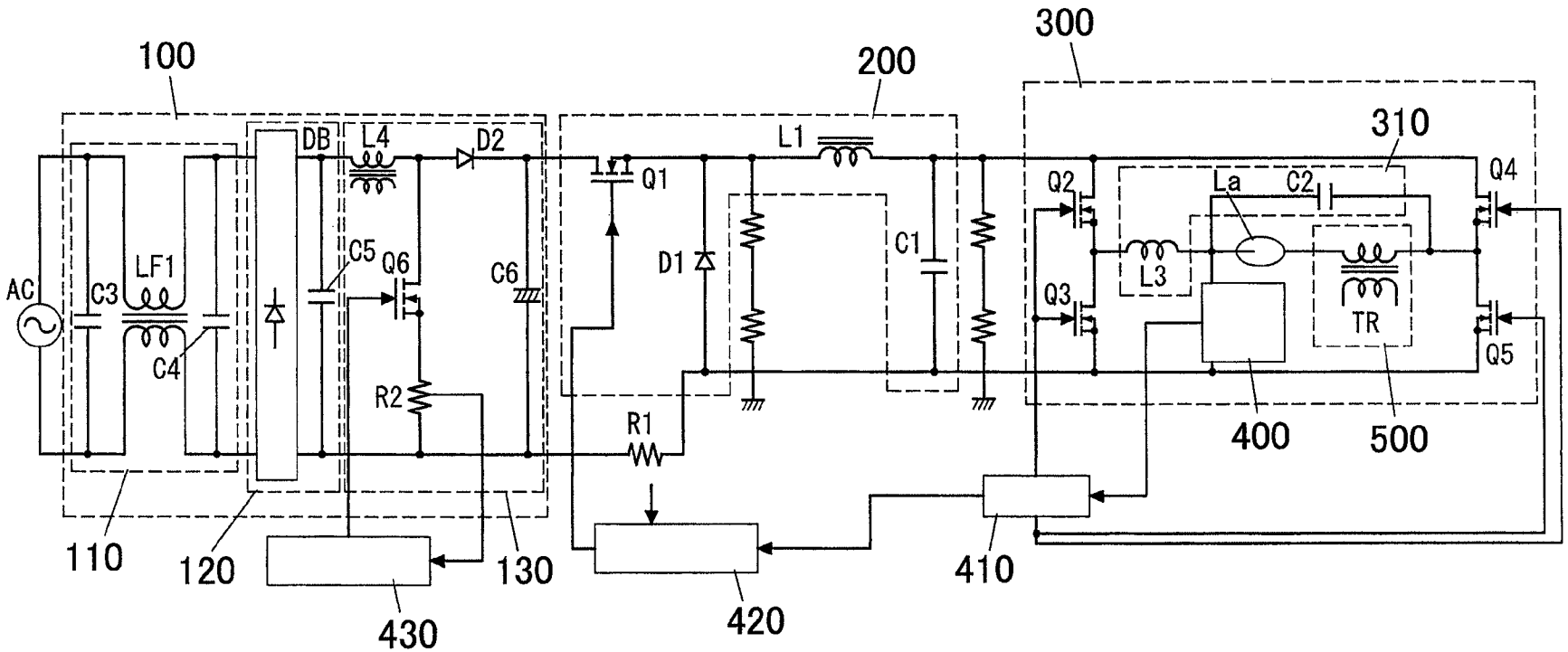
[FIG. 10]

Meanwhile, as shown in FIG. 10, the direct current power source 100 may include a circuit that converts alternating current power inputted from an external alternating current power source AC into the direct current power. The direct current power source 100 in FIG. 10 includes a filter circuit 110, a rectification smoothing unit 120 having a diode bridge DB configured to perform full-wave rectification of the alternating current power inputted from the alternating current power source AC via the filter circuit 110 and a capacitor C5 configured to smooth an output from the diode bridge DB, and an up-converter 130 that steps up the direct current power outputted from the rectification smoothing unit 120 and outputs the stepped-up direct current power. The filter circuit 110 includes a line filter LF1, and two across-the-line capacitors C3 and C4 respectively provided on both sides of the line filter LF1. The up-converter 130 is a well-known circuit also called a boost converter or a step-up converter, which includes an inductor L4 whose one end is connected to an output terminal on a high voltage side of the rectification smoothing unit 120, a diode D2 whose anode is connected to another end of the inductor L4, an output capacitor C6 whose one end is connected to a cathode of the diode D2 and another end is connected to an output terminal on a low voltage side of the rectification smoothing unit 120, and a switching element Q6 whose one end is connected to a connecting point of the inductor L4 to the diode D2 and another end is connected to a connecting point of the rectification smoothing unit 120 to the output capacitor C6 via a resistor R2. Both of terminals of the output capacitor C6 are used as output terminals. Further, this first embodiment includes a step-up drive circuit 430 that maintains the output voltage from the direct current power source 100 constant by performing on-off drive of the switching element Q6 at a duty ratio corresponding to a voltage between both terminals of the resistor R2. This step-up drive circuit 430 can be achieved by well-known techniques and detailed description and illustration thereof will be omitted.

Furthermore, the example in FIG. 10 includes a starter circuit 500 that is provided with a transformer TR whose secondary winding is serially connected to the discharge lamp La and that generates high voltage pulses for starting the discharge lamp La. This starter circuit 500 can be achieved by well-known techniques and detailed description and illustration thereof will be omitted.

The above-described various discharge lamp lighting devices can be used for lighting light sources in well-known lighting fixtures and projectors.

In the above-described first embodiment, the control circuit controls the down-converter circuit on the basis of the detection result by the lighting detection circuit. Accordingly, electrical stresses at the start-up can be reduced as compared to a case where the control circuit controls only the inverter circuit on the basis of the detection result by the lighting detection circuit.

When the asymmetric state is detected by the lighting detection circuit, the control circuit reduces the output voltage from the down-converter circuit thereby reducing the peak value of the output current to the discharge lamp. Hence electrical stresses attributable to the asymmetric state can be reduced.

The control circuit increases the output voltage from the down-converter circuit when the lighting detection circuit detects extinction of the discharge lamp in the state where the asymmetric state is detected by the lighting detection circuit and the output voltage from the down-converter circuit is reduced. Accordingly, the discharge lamp can be lit again promptly as compared to the case of leaving the output voltage from the down-converter reduced even when the lighting detection circuit detects extinction of the discharge lamp.

Second Embodiment

Figure 11:
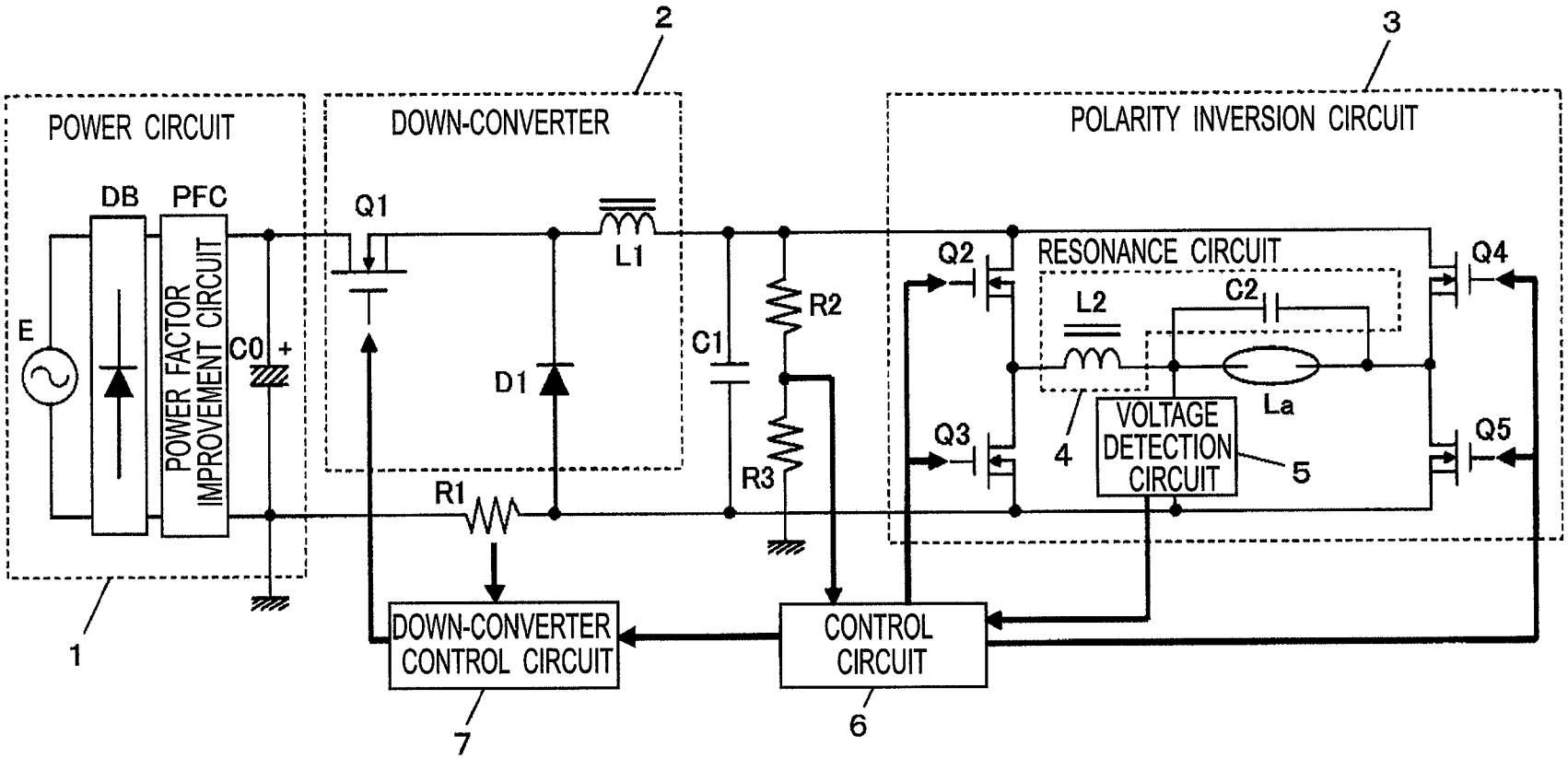
[FIG. 11]

FIG. 11 shows a configuration of a high-pressure discharge lamp lighting device of a second embodiment of the present invention. The high-pressure discharge lamp lighting device of this second embodiment includes a power circuit 1 for obtaining a direct current voltage from a commercial alternating current power source E, a down-converter 2 that steps down the direct current voltage to be supplied from the power circuit 1, and a polarity inversion circuit 3 that inverts the polarity of an output voltage from the down-converter 2. A serial resonance circuit 4 formed of a capacitor C2 and an inductor L2 is connected to an output of the polarity inversion circuit 3, and a high-pressure discharge lamp La is connected to both ends of the capacitor C2. In addition, the high-pressure discharge lamp lighting device includes a control circuit 6 and a down-converter control circuit 7.

The power circuit 1 includes a diode bridge DB that performs full-wave rectification of the commercial alternating current power source E, a power factor improvement circuit PFC formed of a step-up chopper circuit configured to output the direct current voltage which is stepped up by performing high-frequency switching of the direct current voltage subjected to full-wave rectification, and a smoothing capacitor C0 to be charged by an output from the power factor improvement circuit PFC. The power circuit 1 is configured to output the stepped-up direct current voltage while improving an input power factor from the commercial alternating current power source E.

The down-converter 2 is a step-down chopper circuit including a switching element Q1 to be switched at a high frequency, an inductor L1 for energy storage, and a diode D1 for conduction of a regenerated current. The down-converter 2 steps down the direct current outputted from the power circuit 1 by variably controlling a pulse width of the switching element Q1, and charges the capacitor C1.

The polarity inversion circuit 3 is a full-bridge inverter circuit including a series circuit formed of switching elements Q2 and Q3 and a series circuit formed of switching elements Q4 and Q5, which are connected in parallel to both ends of the capacitor C1. The polarity inversion circuit 3 inverts a polarity of the direct current voltage on the capacitor C1 by alternately switching between a state where the switching elements Q2 and Q5 are ON while the switching elements Q3 and Q4 are OFF and a state where the switching elements Q2 and Q5 are OFF while the switching elements Q3 and Q4 are ON, thereby supplying the voltage to a load circuit.

The control circuit 6 generates a high frequency voltage in a range from several tens of kilohertz to several hundreds of kilohertz on both ends of the resonance circuit 4 by turning the pair of the switching elements Q2 and Q5 and the pair of the switching elements Q3 and Q4 located diagonally from each other alternately on and off when starting lighting of the discharge lamp La. This high frequency voltage is stepped up by a resonance action of the resonance circuit 4, thereby generating a high resonance voltage in the capacitor C2. Then, the control circuit 6 turns the set of the switching elements Q2 and Q5 and the set of the switching elements Q3 and Q4 alternately on and off by use of a detection voltage detected by a voltage detection circuit 5, and lights the discharge lamp La by the high resonance voltage. Upon detection of lighting of the discharge lamp La, a low frequency voltage in a range from several tens of hertz to several hundreds of hertz is applied to both ends of the resonance circuit 4 to maintain lighting.

The control circuit 6 detects the output voltage from the down-converter 2 by means of voltage division using a series circuit of resistors R2 and R3. The control circuit 6 provides a control instruction to the down-converter control circuit 7 such that the output voltage from the down-converter 2 is equal to a predetermined value. For example, a peak value of a switching current flowing in a current detection resistor R1 is provided as the control instruction.

Moreover, the resonance voltage of the resonance circuit 4 is detected by use of the voltage detection circuit 5. Although the voltage detection circuit 5 detects a voltage to ground at a connecting point between the inductor L2 and the capacitor C2 in the resonance circuit 4 in the illustrated configuration, a secondary winding may be provided to the inductor L2 and the voltage detection circuit 5 may detect a voltage on the secondary winding. Alternatively, the voltage detection circuit 5 may detect a voltage on both ends of the capacitor C2.

The control circuit 6 can be achieved by a general-purpose microcomputer. The control circuit 6 accurately controls the resonance voltage of the resonance circuit 4 by detecting both of the output voltage from the down-converter 2 and the resonance voltage of the resonance circuit 4 and combining control of a drive frequency of the polarity inversion circuit 3 with control of the output voltage from the down-converter 2.

First, the resonance voltage by the resonance circuit 4 is changed by varying the drive frequency of the polarity inversion circuit 3 so as to approach a resonance point stepwise. A judgment is made as to whether or not the resonance voltage is stepped up to a desired voltage value or above. If the resonance voltage does not reach the desired voltage, operations to change the drive frequency of the polarity inversion circuit 3 and to step up the output voltage from the down-converter 2 are alternately repeated before changing the drive frequency of the polarity inversion circuit 3 to the next frequency, so that the resonance voltage becomes equal to or above the desired voltage value by stepping up the output voltage from the down-converter 2. Hence the resonance voltage is adjusted so as to be equal or above the desired voltage value.

Figure 12:
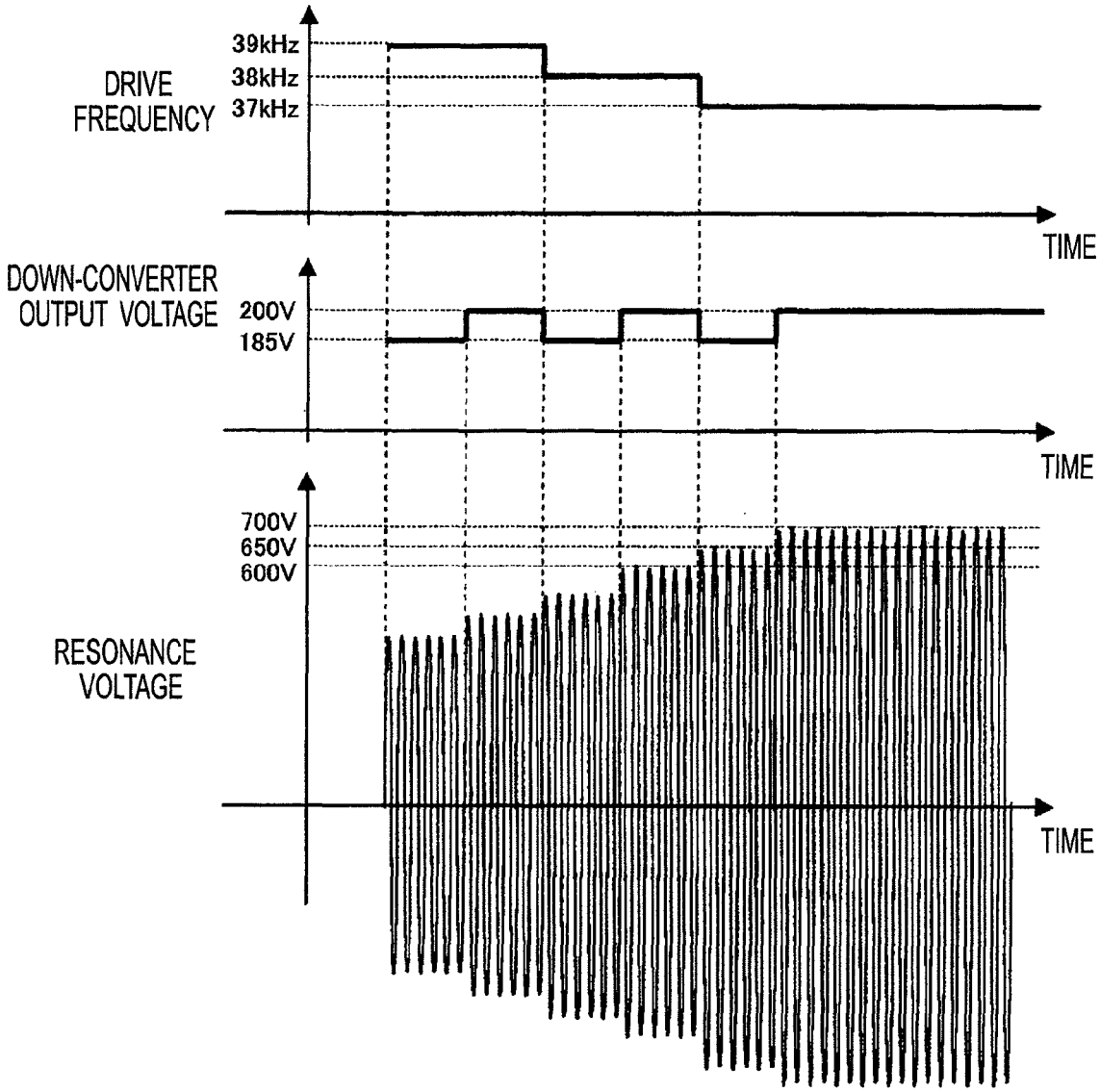
[FIG. 12]
Figure 13:
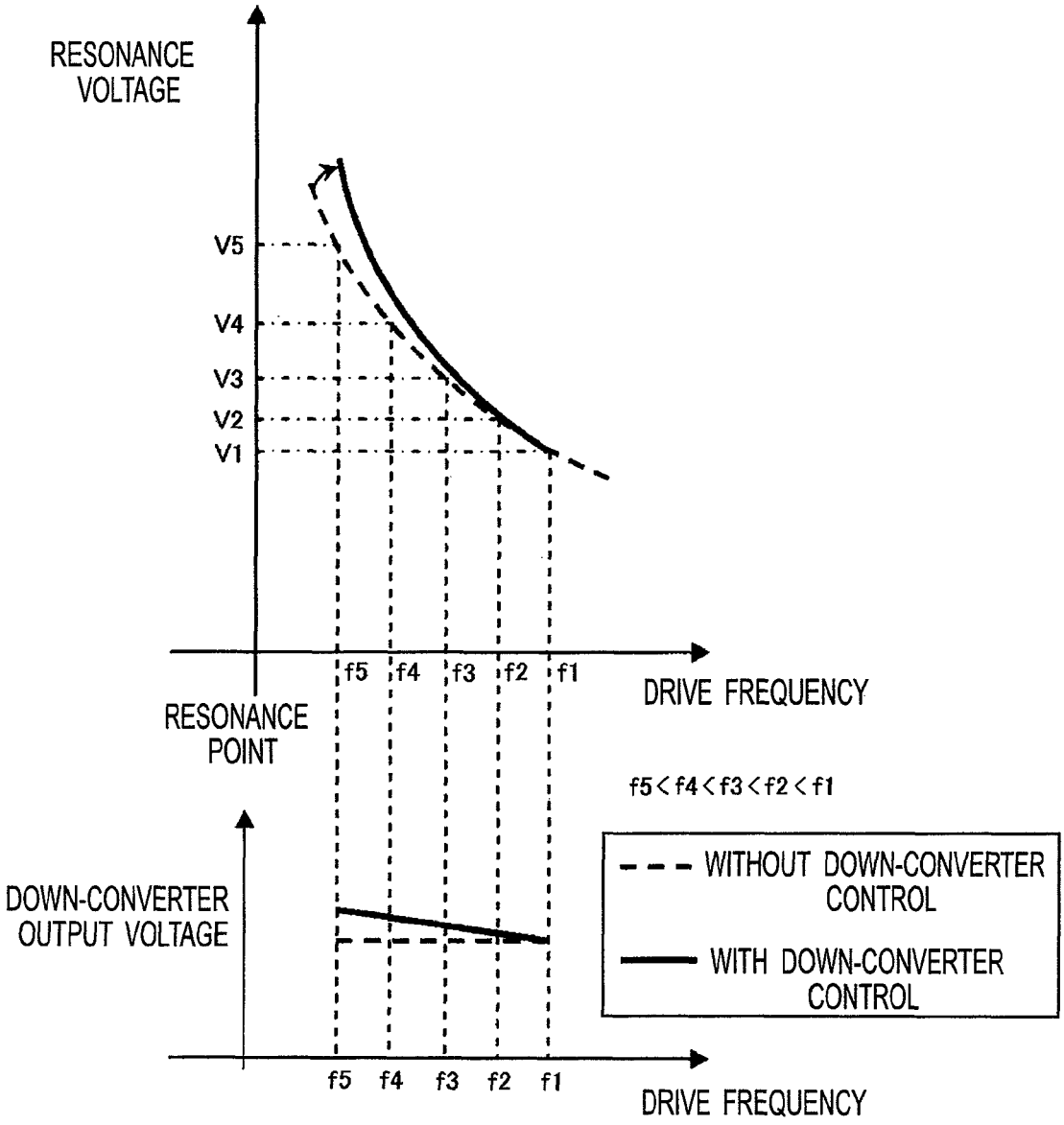
[FIG. 13]

FIG. 12 shows the drive frequency of the polarity inversion circuit 3, the output voltage from the down-converter 2, and the resonance voltage to be applied to the discharge lamp La in the high-pressure discharge lamp lighting device of this second embodiment. FIG. 13 shows a change in the resonance voltage of the resonance circuit 4 in a case of varying the output voltage from the down-converter 2 in conformity to the change in the drive frequency and in a case of not varying the output voltage.

Next, a specific example of the control will be described with reference to FIG. 12. For example, in the settings in which the desired voltage value of the resonance voltage is set to 700 V while the resonance circuit 4 is set to have drive frequency of 75 μH and to have capacitance of 10 nF, the drive frequency of the polarity inversion circuit 3 is changed from 39 kHz, to 38 kHz, and to 37 kHz, so as to come close to the resonance point stepwise. Here, each time the drive frequency is changed by one level, the output voltage from the down-converter 2 is changed between two levels of 185 V and 200 V. In this way, the resonance voltage can be controlled finely even when a step size of the drive frequency is the same. The above-described control can be implemented by using the microcomputer serving as the control circuit 6.

For example, the resonance voltage when the polarity inversion circuit 3 is driven at 38 kHz is assumed to be stepped up to 600 V in a case where the output voltage from the down-converter 2 is to 200 V. Next, the output voltage of the down-converter 2 is set to 185 V. Then, the polarity inversion circuit 3 is changed to the drive frequency of 37 kHz being the next step of the drive frequency of 38 kHz, and is operated. The resonance voltage at this time is assumed to be stepped up to 650 V. Subsequently, the output voltage from the down-converter 2 is set to 200 V while maintaining the drive frequency at the 37 kHz. In this way, the resonance voltage can be adjusted to the 700 V, which is set up as the desired voltage value.

Although illustration is omitted herein, it is also possible to also use an igniter circuit that generates high voltage pulses for starting or restarting the discharge lamp La separately from the resonance circuit 4. For example, the igniter circuit is formed of a capacitor to be charged by the output voltage from the down-converter 2, a switching element to be turned on when a charged voltage of this capacitor exceeds a threshold or in accordance with an instruction from the control circuit 6, and a pulse transformer having a primary winding connected to the capacitor via this switching element. The igniter circuit allows a fine start even in an environment where it is hard to start the discharge lamp La (at a restart, for example) by applying high voltage pulses generated in a secondary winding of the pulse transformer to the discharge lamp La at a timing when the desired voltage value is generated by the resonance circuit 4. The same applies to embodiments to be described below.

Third Embodiment

Figure 14:
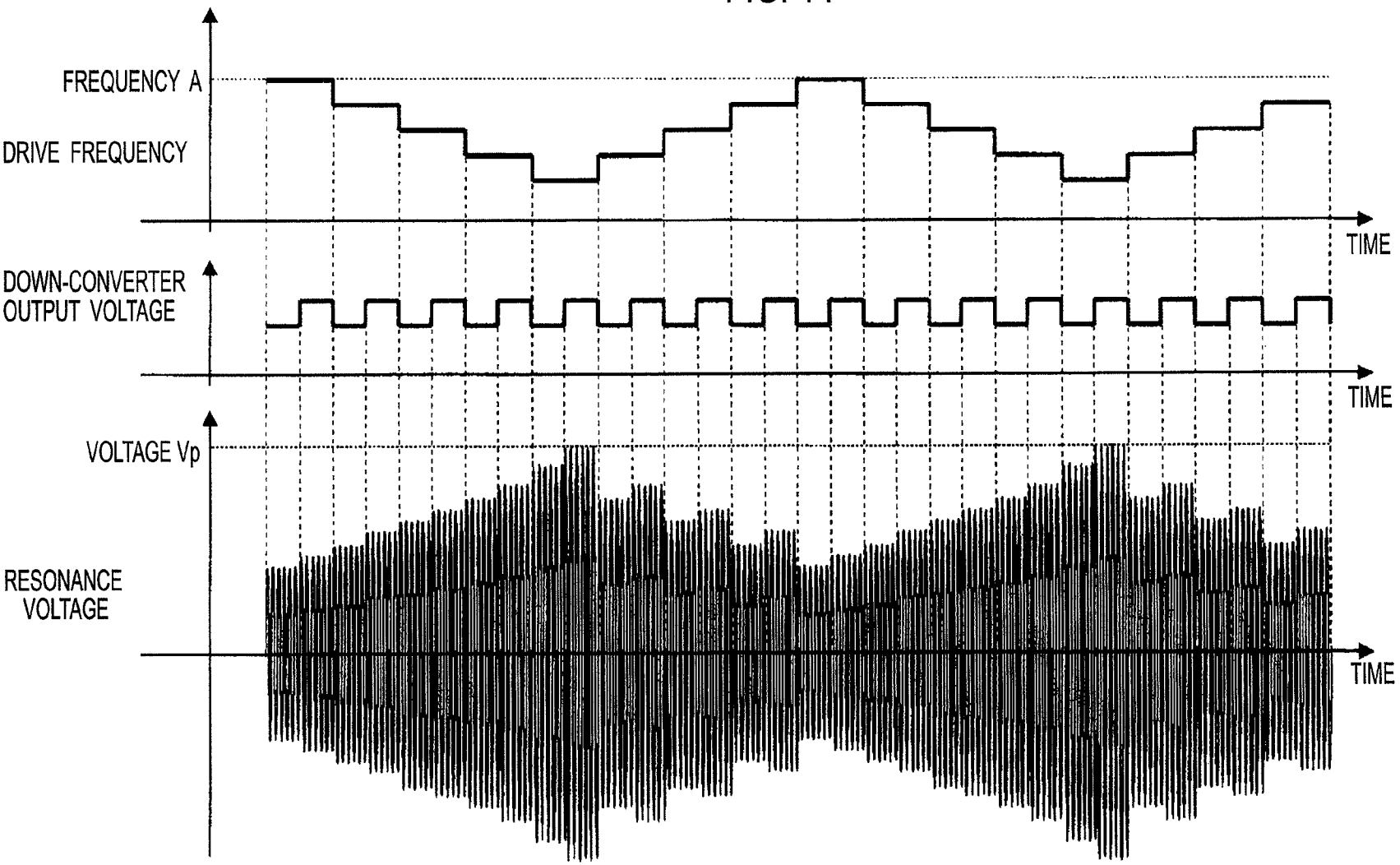
[FIG. 14]
Figure 15:
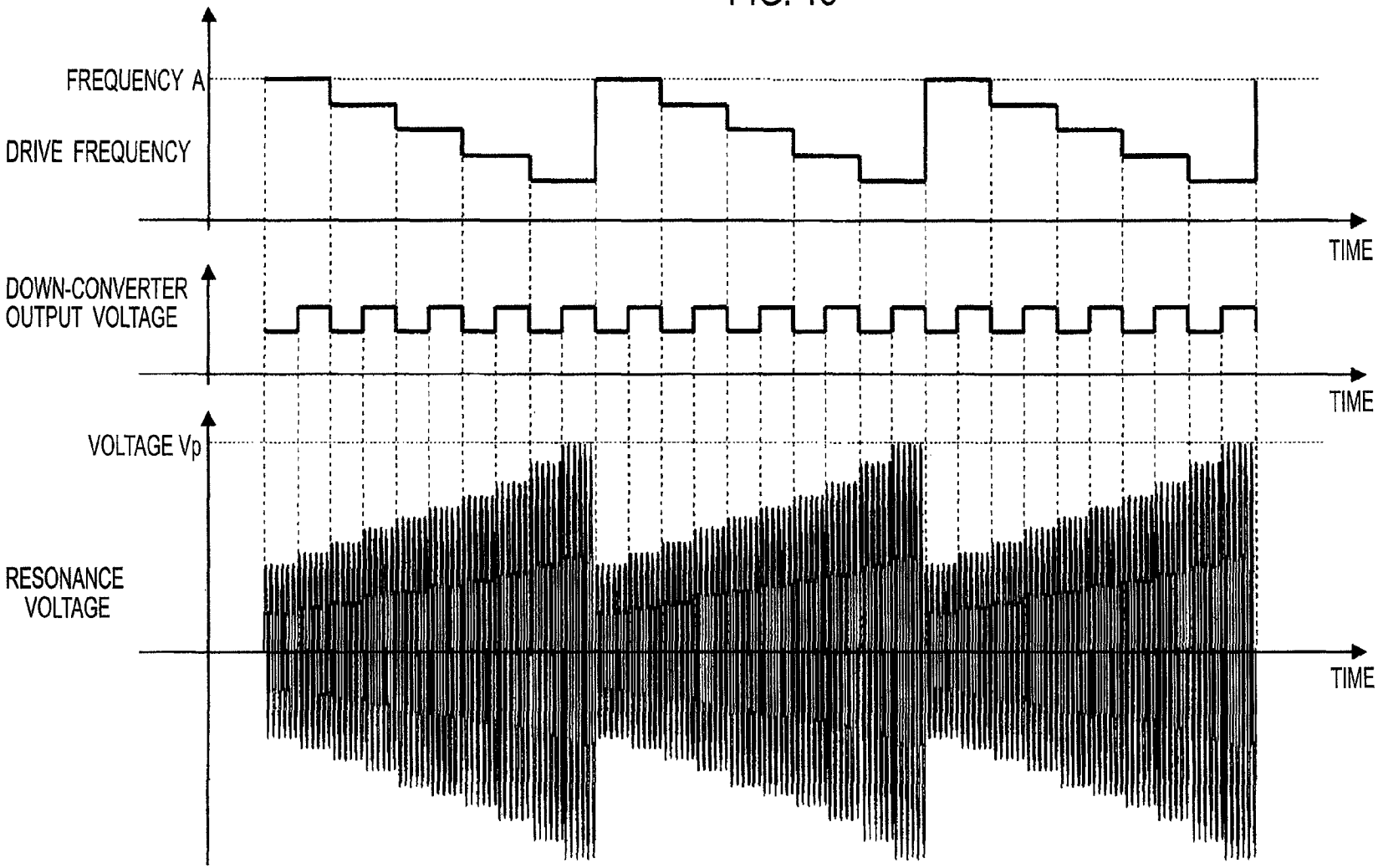
[FIG. 15]

FIG. 14 and FIG. 15 each show a drive frequency of a polarity inversion circuit, an output voltage from a down-converter, and a resonance voltage to be applied to a discharge lamp in a high-pressure discharge lamp lighting device of a third embodiment of the present invention. A circuit configuration is the same as FIG. 11.

A difference from the second embodiment is as follows. Specifically, the sweeping of the drive frequency of the polarity inversion circuit is performed so that the drive frequency is brought gradually closer to a resonance point of the resonance circuit from a frequency A higher than the resonance point. After reaching a desired resonance voltage Vp, in a case of FIG. 14, the drive frequency of the polarity inversion circuit is gradually increased and returns to the frequency A. In the case of FIG. 15, the sweeping of the drive frequency of the polarity inversion circuit is performed again from the frequency A. By varying the output voltage from the down-converter in accordance with the sweep of the drive frequency, fine adjustment of the resonance voltage can be performed. Thus, a variation in the resonance voltage attributable to variations in the inductance and capacitance of the resonance circuit can be suppressed, and the voltage to be applied to the discharge lamp can be supplied stably.

Fourth Embodiment

Figure 16:
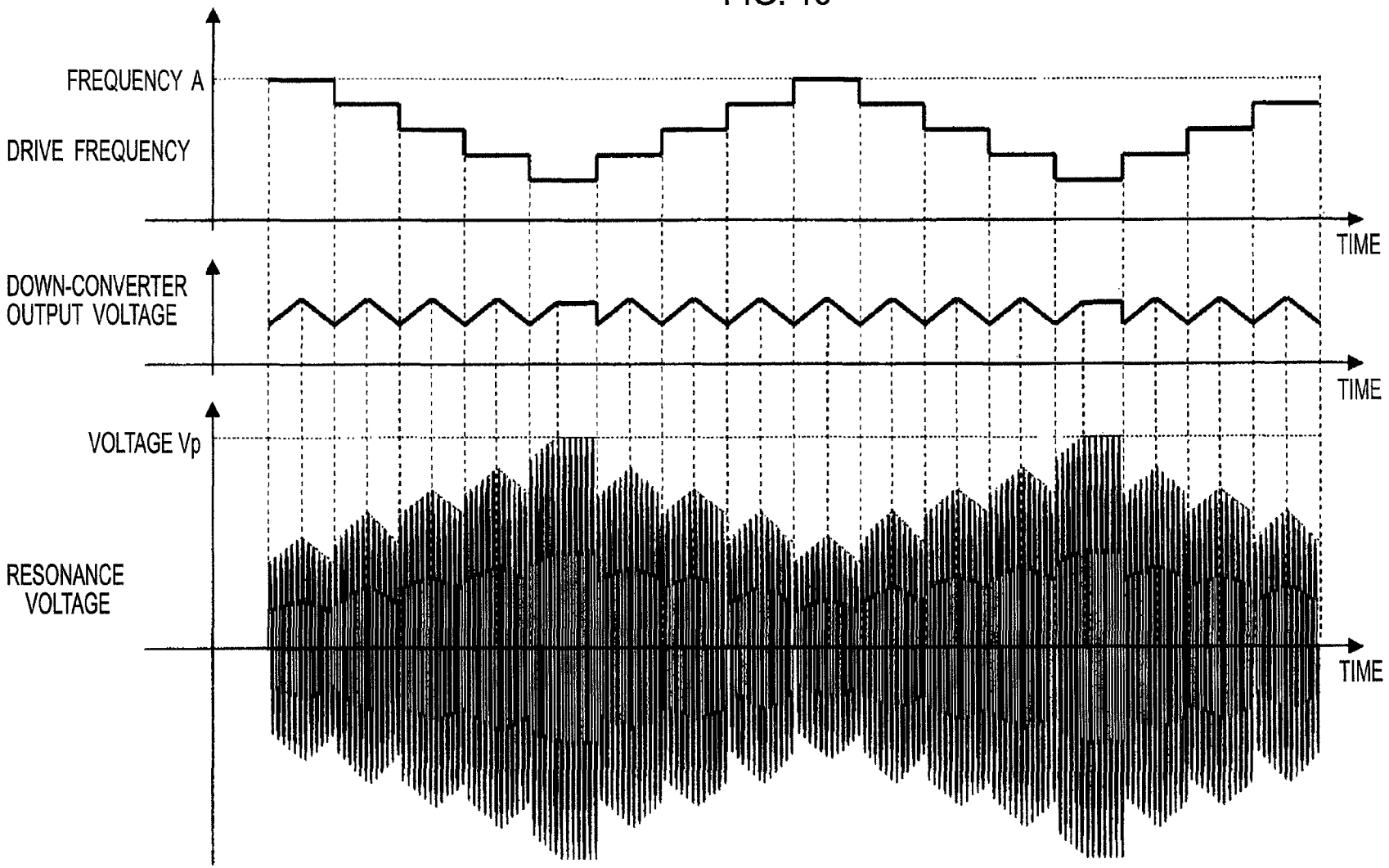
[FIG. 16]
Figure 17:
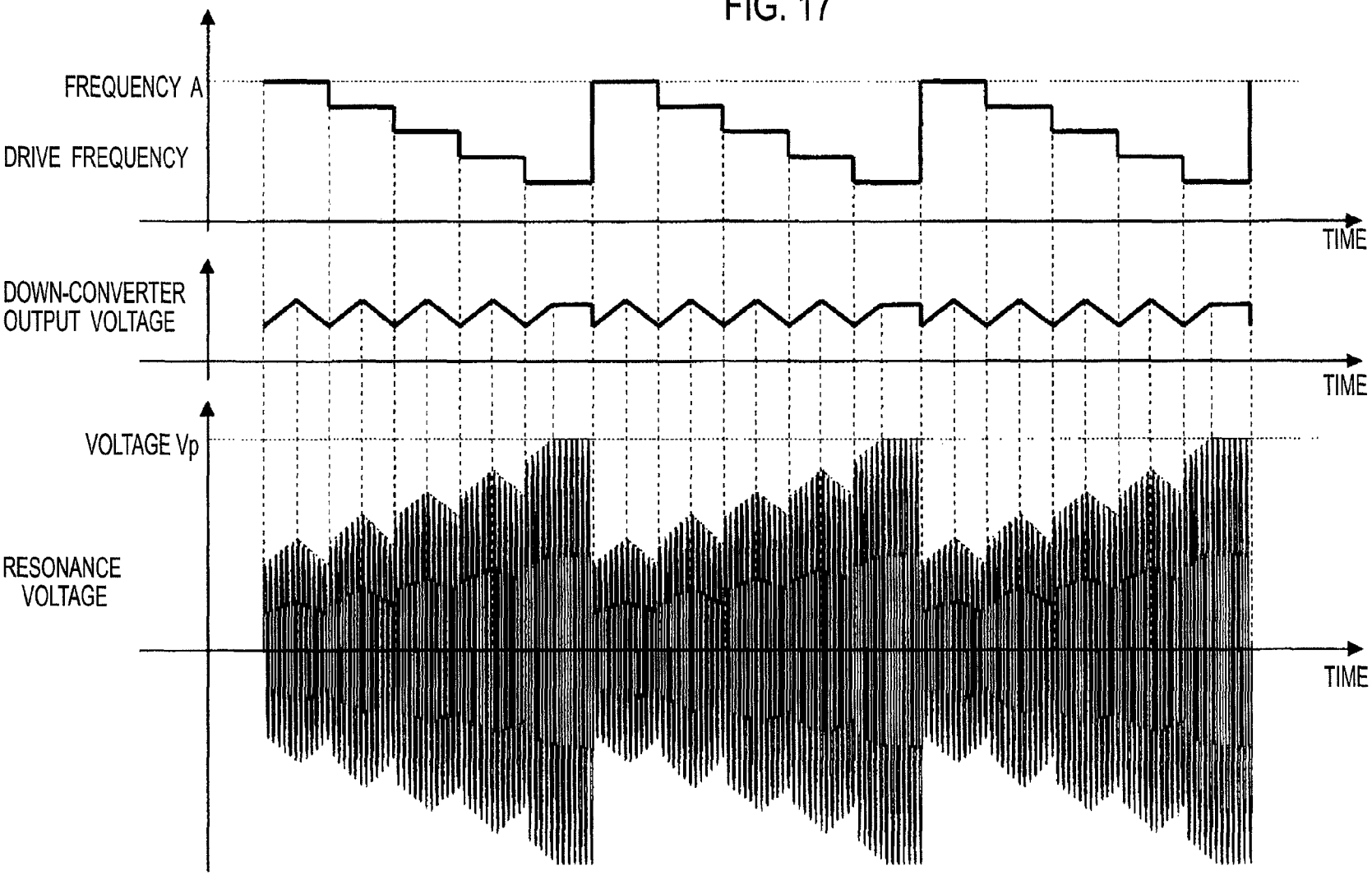
[FIG. 17]

FIG. 16 and FIG. 17 each show a drive frequency of a polarity inversion circuit, an output voltage from a down-converter, and a resonance voltage to be applied to a discharge lamp in a high-pressure discharge lamp lighting device of a fourth embodiment of the present invention. A circuit configuration is the same as FIG. 11.

A difference from the third embodiment is in operation of varying the output voltage from the down-converter. Specifically, as shown in FIG. 16 and FIG. 17, the output voltage from the down-converter is made to vary vertically in a continuous fashion instead of being made to vary stepwise as shown in FIG. 15. Hence it is possible to provide a discharge lamp lighting device which can apply various voltage values to the discharge lamp without modifying the specifications of the resonance circuit.

Figure 18:
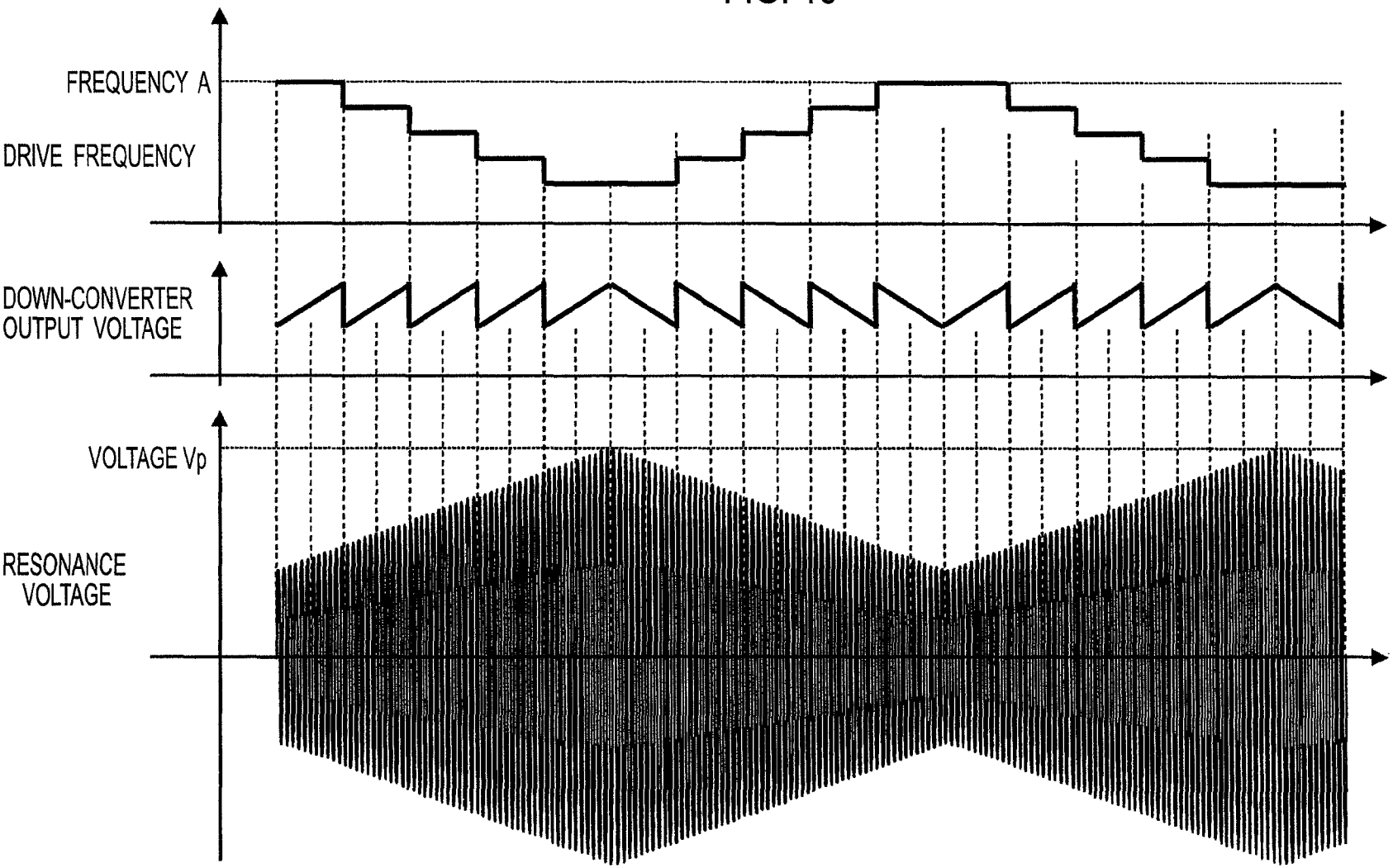
[FIG. 18]
Figure 19:
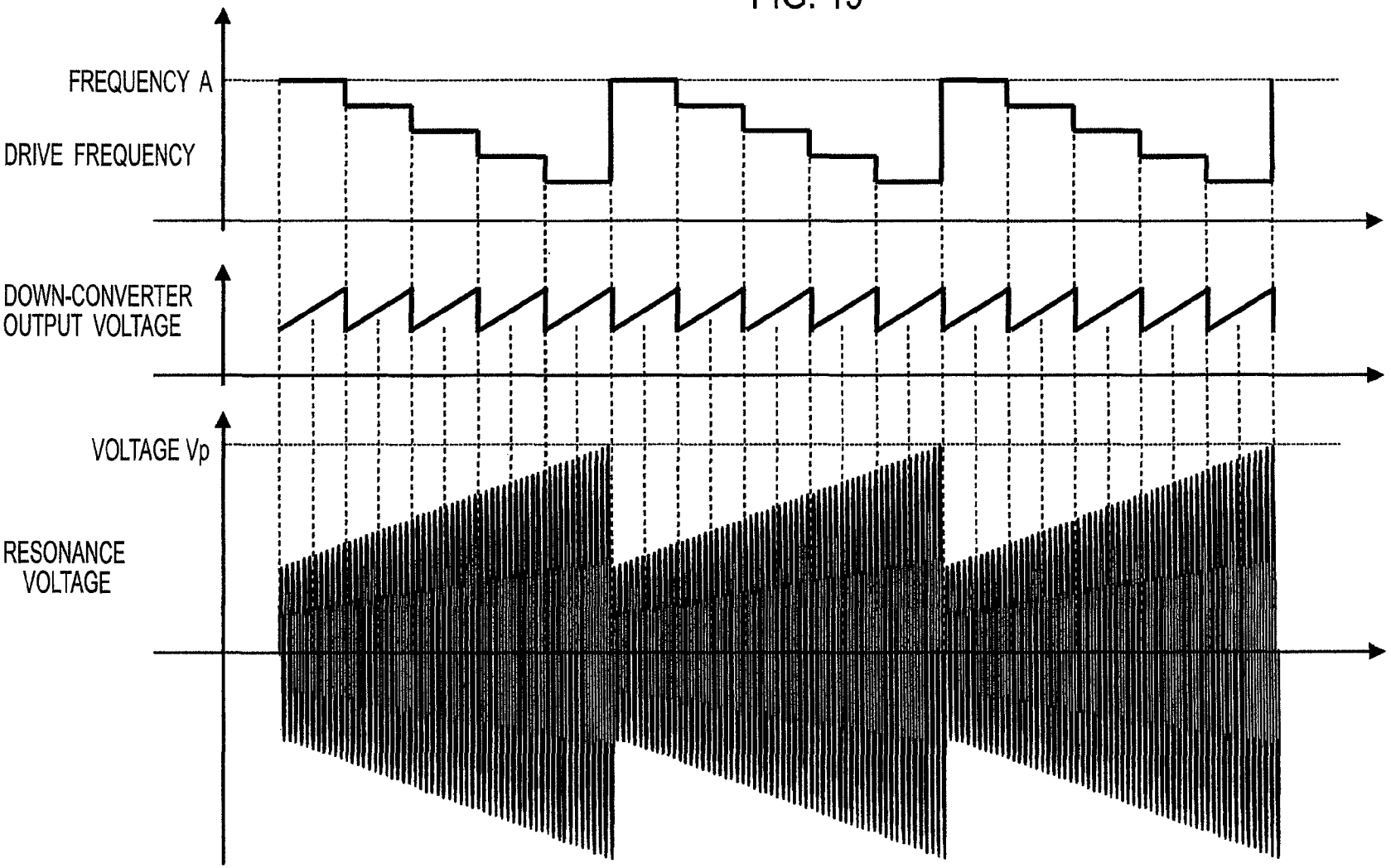
[FIG. 19]

Note that, as shown in FIG. 18 and FIG. 19, the output voltage from the down-converter can be made to vary linearly in conformity to the sweep of the drive frequency, thereby making the resonance voltage to vary linearly.

Fifth Embodiment

Figure 20:
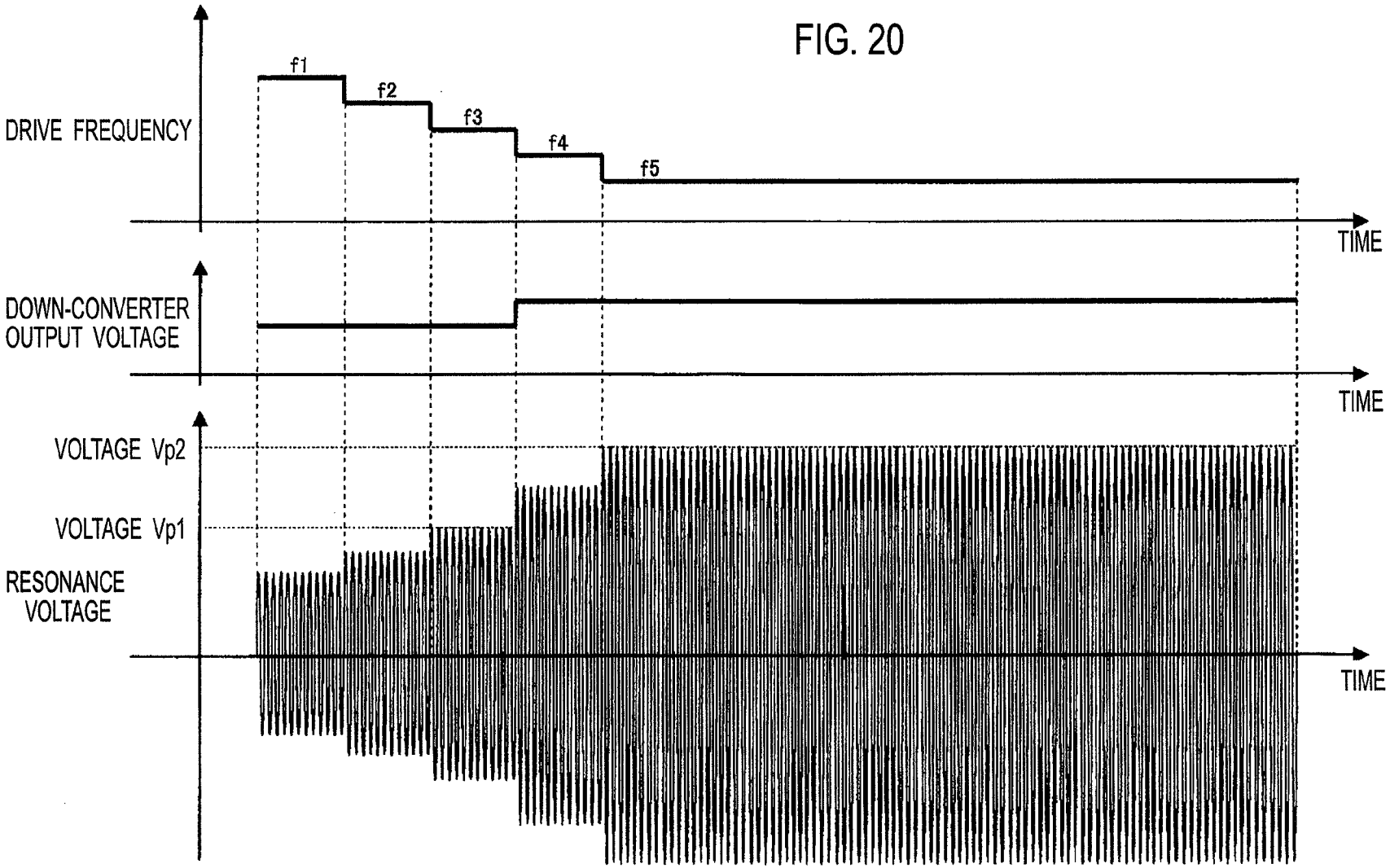
[FIG. 20]

FIG. 20 shows a drive frequency of a polarity inversion circuit, an output voltage from a down-converter, and a resonance voltage to be applied to a discharge lamp in a high-pressure discharge lamp lighting device of a fifth embodiment of the present invention. A circuit configuration is the same as FIG. 11.

A difference from the second to fourth embodiments is as follows. Specifically, the sweeping of the drive frequency of the polarity inversion circuit is swept so that the drive frequency approaches the resonance point, and the resonance voltage is gradually stepped up. Here, the output voltage from the down-converter is not allowed to vary until the resonance voltage reaches the desired voltage value Vp1. The output voltage from the down-converter is allowed to vary (stepped up) after the resonance voltage reaches the predetermined voltage Vp1. The resonance voltage to be eventually obtained after the output voltage from the down-converter is stepped up is a voltage value Vp2.

According to this fifth embodiment, electrical stresses to components on the whole can be reduced by varying the output voltage from the down-converter only within a partial period to generate the resonance voltage for starting the discharge lamp.

Sixth Embodiment

Similar operations can be achieved by using, as the resonance frequency of the resonance circuit, a harmonic frequency of an odd number multiple (2n+1 times, n is a natural number) of a frequency at the time of start control of the polarity inversion circuit. Such frequency is used from a viewpoint of downsizing the components constituting the resonance circuit while obtaining substantially the same voltage amplitude as in the case of the driving at the frequencies stated in the second to fifth embodiment.

Seventh Embodiment

Figure 21:
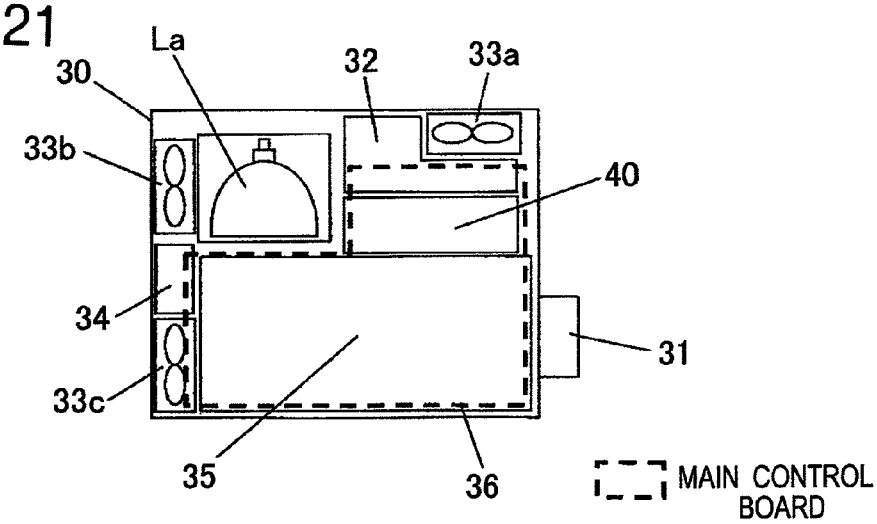
[FIG. 21]

Each of the high-pressure discharge lamp lighting devices of the above-described embodiments is used for lighting a high-pressure discharge lamp being a light source for a projector. FIG. 21 is a schematic diagram showing an internal configuration of the projector. In the drawing, reference numeral 31 denotes a projection window, reference numeral 32 denotes a power source unit, reference numerals 33*a*, 33*b*, and 33*c* denote cooling fans, reference numeral 34 denotes an external signal input unit, reference numeral 35 denotes an optical system, reference numeral 36 denotes a main control board, reference numeral 40 denotes a discharge lamp lighting device, and reference code La denotes a discharge lamp. The main control board is mounted in a frame indicated with a dashed line. Image displaying means (a transmissive liquid crystal display panel or a reflective image display device) for transmitting or reflecting light from the discharge lamp La is provided in the middle of the optical system 35. Hence the optical system 35 is designed to project either transmitted light or reflected light by way of this image displaying means onto a screen. In this way, the discharge lamp lighting device is mounted inside the projector 30 together with the discharge lamp La. By applying the discharge lamp lighting device of this embodiment, it is possible to suppress a variation in a starting voltage and to ensure stable start even if there are variations in the component values of components of the resonance circuit.

Here, the high-pressure discharge lamp lighting device of the present invention can be applied to an image display device in which a projector and a screen is integrated, such as a rear-projection television set.

Sixth Embodiment

Figure 22A:
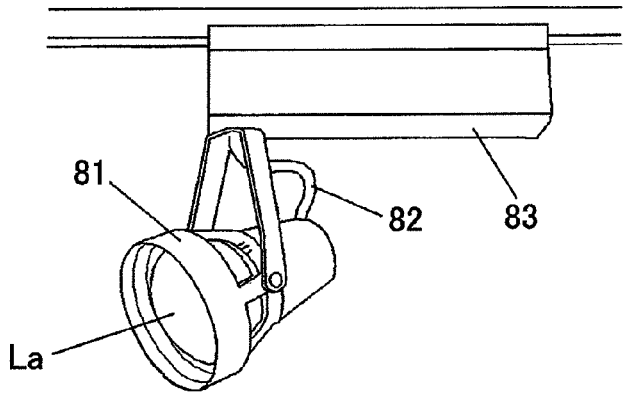
[FIG. 22] FIGS. 22(*a*) and 22(*b*) are schematic configuration diagrams of a lighting fixture of an eighth embodiment of the present invention.
Figure 22B:
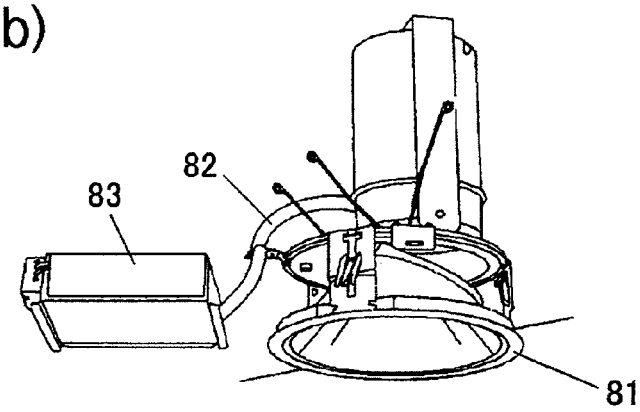

FIG. 22 shows configuration examples of lighting fixtures applying the high-pressure discharge lamp lighting device of the present invention. FIG. 22(*a*) shows an example of using a HID lamp as a spotlight and FIG. 22(*b*) shows an example of using a HID lamp as a downlight. In the drawings, reference code La denotes a high-pressure discharge lamp (the HID lamp), reference numeral 81 denotes a lamp body fitted with the high-pressure discharge lamp, reference numeral 82 denotes wiring, and reference numeral 83 denotes an electronic ballast incorporating the circuits of the lighting device. It is also possible to construct a lighting system by combining more than one of these lighting fixtures. The stable start can be ensured by applying the high-pressure discharge lamp lighting device according to any of the above-described second to sixth embodiments as the lighting device for these lighting fixtures.

INDUSTRIAL APPLICABILITY

The present invention can be used as a discharge lamp lighting device for lighting various high intensity discharge lamps such as a high-pressure mercury lamp and a metal halide lamp.

EXPLANATION OF REFERENCE NUMERALS

1 POWER CIRCUIT
2, 200 DOWN-CONVERTER
3 POLARITY INVERSION CIRCUIT
4 RESONANCE CIRCUIT
5 VOLTAGE DETECTION CIRCUIT
6 CONTROL CIRCUIT
7 DOWN-CONVERTER CONTROL CIRCUIT
100 DIRECT CURRENT POWER SOURCE
300 INVERTER CIRCUIT
310 RESONATOR
400 LIGHTING DETECTION CIRCUIT
410 INVERTER DRIVE CIRCUIT
420 STEP-DOWN DRIVE CIRCUIT
430 STEP-UP DRIVE CIRCUIT
La HIGH-PRESSURE DISCHARGE LAMP

The invention claimed is:

1. A lighting device for a discharge lamp comprising:

a direct current power source;

a down-converter circuit configured to step down a direct current voltage supplied from the direct current power source;

a polarity inversion circuit configured to receive an output voltage from the down-converter circuit and apply the output voltage to the discharge lamp with a polarity of the output voltage inverted periodically;

a resonance circuit configured to generate a starting voltage for starting up the discharge lamp;

a control circuit configured to control the down-converter circuit, the polarity inversion circuit, and the resonance circuit to control lighting of the discharge lamp;

a voltage detector configured to detect the output voltage from the down-converter circuit configured to step down the direct current voltage;

a detector configured to detect a state of output of the polarity inversion circuit;

an output voltage determiner configured to determine the output voltage from the down-converter circuit on a basis of the output voltage from the down-converter circuit detected by the voltage detector and the state of output of the polarity inversion circuit detected by the detector; and a lighting detector configured to detect lighting and extinction of the discharge lamp, and detect whether a current in the discharge lamp is in an asymmetric state during a period of detecting lighting of the discharge lamp, wherein the control circuit reduces the output voltage from the down-converter circuit when the asymmetric state is detected by the lighting detector.

2. The lighting device for the discharge lamp according to claim 1, further comprising a preheating mode to preheat electrodes of the discharge lamp between a starting mode to operate the polarity inversion circuit at a relatively high frequency to resonate the resonance circuit and thereby to light the discharge lamp and a low frequency operation in normal lighting.

3. The lighting device for the discharge lamp according to claim 2, further comprising:

a detector configured to detect an output voltage from the resonance circuit.

4. The lighting device for the discharge lamp according to claim 1, wherein drive frequencies of the polarity inversion circuit at a start-up and in a preheating mode are equal to or above 10 kHz, and a drive frequency of the polarity inversion circuit during a normal lighting is equal to or below 1 kHz.

5. The lighting device for the discharge lamp according to claim 1, wherein a resonance voltage of the resonance circuit and whether or not the discharge lamp is lit are detected from a winding on a secondary side of inductance of the resonance circuit.

6. The lighting device for the discharge lamp according to claim 1, wherein a resonance voltage of the resonance circuit and whether or not the discharge lamp is lit are detected from capacitance of the resonance circuit.

7. The lighting device for the discharge lamp according to claim 1, further comprising an igniter circuit configured to generate a starting voltage for starting up the discharge lamp separately from the resonance circuit.

8. The lighting device for the discharge lamp according to claim 1, wherein the lighting device for the discharge lamp is used for lighting a lighting fixture.

9. The lighting device for the discharge lamp according to claim 1, wherein the lighting device for the discharge lamp is a lighting device for a light source for a projector.

10. The lighting device for the discharge lamp according to claim 1, wherein the control circuit increases the output voltage from the down-converter circuit when the lighting detector detects extinction of the discharge lamp in a state where the asymmetric state is detected by the lighting detector and the output voltage from the down-converter circuit is reduced.

11. A lighting device for a discharge lamp comprising:

a direct current power source;

a down-converter circuit configured to step down a direct current voltage supplied from the direct current power source;

a polarity inversion circuit configured to receive an output voltage from the down-converter circuit and apply the output voltage to the discharge lamp with a polarity of the output voltage inverted periodically;

a resonance circuit configured to generate a starting voltage for starting up the discharge lamp;

a control circuit configured to control the down-converter circuit, the polarity inversion circuit, and the resonance circuit to control lighting of the discharge lamp;

a voltage detector configured to detect the output voltage from the down-converter circuit configured to step down the direct current voltage;

a detector configured to detect a state of output of the polarity inversion circuit;

an output voltage determiner configured to determine the output voltage from the down-converter circuit on a basis of the output voltage from the down-converter circuit detected by the voltage detector and the state of output of the polarity inversion circuit detected by the detector;

an operation of sweeping a drive frequency of the polarity inversion circuit to bring close to a resonance point of the resonance circuit; and an operation of varying the output voltage from the down-converter circuit, to be alternately performed for adjustment of a resonance voltage to a desired voltage.

12. A lighting device for a discharge lamp comprising:

a direct current power source;

a down-converter circuit configured to step down a direct current voltage supplied from the direct current power source;

a polarity inversion circuit configured to receive an output voltage from the down-converter circuit and apply the output voltage to the discharge lamp with a polarity of the output voltage inverted periodically;

a resonance circuit configured to generate a starting voltage for starting up the discharge lamp;

a control circuit configured to control the down-converter circuit, the polarity inversion circuit, and the resonance circuit to control lighting of the discharge lamp;

a voltage detector configured to detect the output voltage from the down-converter circuit configured to step down the direct current voltage a detector configured to detect a state of output of the polarity inversion circuit;

an output voltage determiner configured to determine the output voltage from the down-converter circuit on a basis of the output voltage from the down-converter circuit detected by the voltage detector and the state of output of the polarity inversion circuit detected by the detector; and an operation of varying the output voltage from the down-converter circuit when a resonance voltage reaches a desired value or higher through an operation of sweeping a drive frequency of the polarity inversion circuit.

13. A lighting device for a discharge lamp comprising:

a direct current power source;

a down-converter circuit configured to step down a direct current voltage supplied from the direct current power source;

a polarity inversion circuit configured to receive an output voltage from the down-converter converter circuit and apply the output voltage to the discharge lamp with a polarity of the output voltage inverted periodically;

a resonance circuit configured to generate a starting voltage for starting up the discharge lamp;

a control circuit configured to control the down-converter circuit, the polarity inversion circuit, and the resonance circuit to control lighting of the discharge lamp;

a voltage detector configured to detect the output voltage from the down-converter circuit configured to step down the direct current voltage;

a detector configured to detect a state of output of the polarity inversion circuit; and an output voltage determiner configured to determine the output voltage from the down-converter circuit on a basis of the output voltage from the down-converter circuit detected by the voltage detector and the state of output of the polarity inversion circuit detected by the detector, wherein, when a current flows in the discharge lamp in an asymmetrical or symmetrical state during a high frequency operation of the polarity inversion circuit immediately after lighting of the discharge lamp, the output voltage from the down-converter circuit to the polarity inversion circuit is varied depending on either one of the states of the current flowing in the discharge lamp.

14. A lighting device for a discharge lamp comprising:

a direct current power source;

a down-converter circuit configured to step down a direct current voltage supplied from the direct current power source;

a polarity inversion circuit configured to receive an output voltage from the down-converter circuit and apply the output voltage to the discharge lamp with a polarity of the output voltage inverted periodically;

a resonance circuit configured to generate a starting voltage for starting up the discharge lamp;

a control circuit configured to control the down-converter circuit, the polarity inversion circuit, and the resonance circuit to control lighting of the discharge lamp;

a voltage detector configured to detect the output voltage from the down-converter circuit configured to step down the direct current voltage;

a detector configured to detect a state of output of the polarity inversion circuit; and an output voltage determiner configured to determine the output voltage from the down-converter circuit on a basis of the output voltage from the down-converter circuit detected by the voltage detector and the state of output of the polarity inversion circuit detected by the detector, wherein the output voltage from the down-converter circuit is returned to an output voltage from the down-converter at a start-up upon occurrence of extinction during a high frequency operation of the polarity inversion circuit immediately after lighting of the discharge lamp.

* * * * *